US006475697B2

(12) United States Patent
Arimoto et al.

(10) Patent No.: US 6,475,697 B2
(45) Date of Patent: Nov. 5, 2002

(54) PHOTOTHERMOGRAPHIC DRY IMAGING MATERIAL EASY TO SEPARATE EMULSION LAYER FROM SUPPORT AND METHOD FOR SEPARATION

(75) Inventors: Tadashi Arimoto; Takayuki Sasaki; Yasuo Kurachi; Eiichi Ueda; Akihisa Nakajima, all of Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/817,634

(22) Filed: Mar. 26, 2001

(65) Prior Publication Data

US 2001/0038981 A1 Nov. 8, 2001

(30) Foreign Application Priority Data

Mar. 31, 2000 (JP) ..... 2000-097065

(51) Int. Cl.[7] ..... G03C 1/498; G03C 1/89; G03C 1/93; G03C 1/805

(52) U.S. Cl. ..... 430/263; 430/262; 430/527; 430/531; 430/536; 430/619; 430/534

(58) Field of Search ..... 430/262, 263, 430/619, 523, 531, 534, 536, 527

(56) References Cited

U.S. PATENT DOCUMENTS

| | | | | | |
|---|---|---|---|---|---|
| 3,409,430 | A | * | 11/1968 | Limberger | 430/263 |
| 4,818,662 | A | * | 4/1989 | Aono et al. | 430/263 |
| 5,264,334 | A | * | 11/1993 | Przezdziecki et al. | 430/619 |
| 6,110,659 | A | * | 8/2000 | Hatakeyama et al. | 430/619 |
| 6,162,597 | A | * | 12/2000 | Bauer et al. | 430/619 |
| 6,165,706 | A | * | 12/2000 | Fujiwhara et al. | 430/619 |
| 6,207,364 | B1 | * | 3/2001 | Takamuki et al. | 430/619 |

* cited by examiner

*Primary Examiner*—Richard L. Schilling
(74) *Attorney, Agent, or Firm*—Frishauf, Holtz, Goodman & Chick, P.C.

(57) ABSTRACT

A photothermographic dry imaging material is disclosed. The imaging material comprises a support, a photosensitive layer containing at least an organic silver salt, photosensitive silver halide, reducing agent and a binder, and a subbing layer containing a water-soluble polymer having a hydroxy group, provided on the support.

10 Claims, No Drawings

PHOTOTHERMOGRAPHIC DRY IMAGING MATERIAL EASY TO SEPARATE EMULSION LAYER FROM SUPPORT AND METHOD FOR SEPARATION

FIELD OF THE INVENTION

The present invention relates to a photothermographic dry imaging material which exhibits high image quality as well as excellent storage stability, and excellent re-usability of resources, and specifically to a silver salt black-and-white photothermographic dry imaging material which exhibits excellent layer adhesion as well as excellent adhesive properties of its photosensitive layer and its backing layer after heat development, excellent silver image storage stability, and easy separation of an emulsion layer from a support.

BACKGROUND OF THE INVENTION

Heretofore, in the medical and printing plate making fields, effluent resulting from wet type processing for image forming materials became problematic in terms of workability, and in recent years, from the viewpoint of environmental protection as well as space saving, a decrease in processing effluent has been highly demanded.

Accordingly, demanded have been techniques, regarding photothermographic materials, for use in photographic techniques in which efficient exposure can be performed utilizing laser imagers and image setters, and can form clear black-and-white images at high resolution.

As described, for example, in U.S. Pat. Nos. 3,152,904 and 3,487,075, as well as in D. Morgan, "Dry Silver Photographic Materials", (Handbook of Imaging Materials, Marcel Dekker, Inc., page 48, 1991), photothermographic dry imaging materials (heat developable photosensitive materials), comprising a support having thereon organic silver salts, photosensitive silver halide grains, and reducing agents, have been known. Since such photothermographic dry imaging materials do not at all use a solution basically comprised of processing chemicals, it is possible to provide customers with a system which is simple, and does not pollute the environment.

Incidentally, these photothermographic dry imaging materials comprise a support having thereon a photosensitive layer, which forms images by thermally developing, commonly at 80 to 140° C., organic silver salts as the supply source of silver ions, utilizing incorporated reducing agents and photosensitive silver grains as the light sensor, and a backing layer comprising dyes to absorb the laser beam. It is required that these layers firmly adhere onto said support not only before thermal development, but also after the same. Silver halide photosensitive photographic materials commonly comprise a support having thereon a sublayer, to allow a photosensitive layer, a backing layer or an intermediate layer to adhere to said support. In heat developable photosensitive materials, a sublayer is effectively provided to assure said adhesion. However, when the sublayer of heat developable materials is designed, consideration specific to thermal development, which is different from photosensitive materials which are developed utilizing conventional developers, is required.

For instance, since photothermographic dry imaging materials comprise organic silver salts, photosensitive silver halide grains, and reducing agents, fogging tends to result during storage prior to heat development as well as during heat development. Specifically, since said photosensitive layer deteriorates when exposed to water, it has been considered that in order to maintain the storage stability prior to development, also said sublayer is comprised of water insoluble materials. Furthermore, being different from photosensitive materials which employ gelatin as the major binder and are prepared by coating water based coating compositions, coating is carried out employing organic solvent based emulsion layer or backing layer coating compositions comprised in which hydrophobic binders are dissolved. Therefore, it is necessary to result in adhesive properties by proving a sublayer compatible with these layers. Furthermore, since heat development is carried out at a relatively high temperature, commonly being from 80 to 140° C., adhesion after heat development is required. In heat developable photosensitive materials as previously described, it is required that said sublayer exhibits high adhesive properties as well as hydrophobicity. On the other hand, when heat developable photosensitive materials are disposed of, in the same manner as photosensitive materials which are developed employing conventional developers, it is required that the emulsion layer be separated from the support so that silver and supports, which are valuable resources, are recovered to make it possible to effectively reutilize said recourses.

However, from the storage stability and adhesive properties of heat developable photosensitive materials, water insoluble subbing materials are required, while for separating the emulsion layer from the support, water-soluble subbing materials are required to ease processing. It has been very difficult to satisfy both requirements.

SUMMARY OF THE INVENTION

Accordingly, an object of the present invention is to provide a photothermographic dry imaging material which exhibits high image quality, minimizes fogging, which occurs after extended storage of said photothermographic dry imaging material, and exhibits excellent adhesive properties of a backing layer with its support before and after heat development, and in addition exhibit easy separation of the emulsion layer from the support, and further, a method to separate the emulsion layer from the support.

The invention and its embodiment are descrbed.

1. A photothermographic dry imaging material comprising a support, a photosensitive layer containing at least an organic silver salt, photosensitive silver halide, a reducing agent and a binder, and a subbing layer containing a water-soluble polymer having a hydroxy group, provided on the support.
2. The photothermographic dry imaging material of item 1, wherein the water-soluble polymer is polyvinyl alcohol or a polymer comprising vinylalcohol unit.
3. The photothermographic dry imaging material of item 1, wherein the water-soluble polymer is ethylenically copolymerized polyvinyl alcohol.
4. The photothermographic dry imaging material of item 1, wherein the subbing layer comprises butyral resin.
5. The photothermographic dry imaging material of item 4, wherein the water-soluble polymer having a hydroxy group is polyvinyl alcohol.
6. The photothermographic dry imaging material of item 4, wherein the water-soluble polymer having a hydroxy group is ethylenically copolymerized polyvinyl alcohol.
7. The photothermographic dry imaging material of item 1, comprising a subbing layer containing a water-soluble polymer having a hydroxy group on both sides of the support.
8. The photothermographic dry imaging material of item 1, wherein the subbing layer is composed of two or more sublayers and the sublayer farthest from the support contains a water-soluble polymer having a hydroxy group.

9. The photothermographic dry imaging material of item 8, wherein a sublayer contacting to the support comprises polymer latex.

10. The photothermographic dry imaging material of item 1, wherein the subbing layer is composed of two or more sublayers, and at least one of the sublayers is electrically conductive.

11. The photothermographic dry imaging material of item 1, wherein the binder comprises a butyral resin.

12. The photothermographic dry imaging material of item 5, wherein the subbing layer on at least one side of the support is composed of two or more sublayer, and the sublayer farthest from the support contains the water-soluble polymer and an aqueous butyral resin.

13. The photothermographic dry imaging material of item 12, wherein a sublayer contacting to the support comprises polymer latex.

14. The photothermographic dry imaging material of item 5, wherein the subbing layer containing butyral resin is formed by coating composition containing liquid in which butyral resin is dispersed.

15. The photothermographic dry imaging material of item 4, wherein the butyral resin is particles having number average diameter of 50 to 1000 nm.

16. The photothermographic dry imaging material of item 15, wherein the butyral resin is contained in amount of 2 to 40 percent by weight with respect to weight of the water-soluble polymer.

17. The photothermographic dry imaging material of item 16, wherein the water-soluble polymer comprises polyvinyl alcohol unit 50 percent or more by molar ratio.

18. The photothermographic dry imaging material of item 17, wherein the subbing layer contains the water-soluble polymer in amount of 40 percent by weight or more.

A method to separate an emulsion layer from its support by treating any one of said photothermographic dry silver imaging materials, employing an alkaline aqueous solution.

DETAILED DESCRIPTION OF THE INVENTION

The present invention relates to a heat developable photosensitive material, which is commonly not immersed in a liquid medium. Therefore, as a method to separate an emulsion layer from its support, when water-soluble materials are employed in the sublayer, separation is easily carried out employing a wet system. However, the heat developable photosensitive material tends to result in fogging due to the effects of moisture, and when water-soluble materials are employed in the sublayer, the storage stability of the emulsion is degraded. The inventors of the present invention investigated a sublayer which minimizes effects to emulsions, exhibits excellent adhesive properties of the emulsion layer to its support and makes it possible to easily separate the emulsion layer from the support at disposition. As a result, it was discovered that contradicting problems were overcome by employing a water-soluble polymer having a specified structure, or a water-soluble polymer having specified properties.

The present invention will now be detailed.

The sublayer as described in the present invention refers to all layers applied between the support and the image forming layer, and one or more layers may be provided.

The heat developable photosensitive photographic material of the present invention comprises a support having, on at least one surface of said support, an image forming layer and a sublayer adjacent to the image forming layer, and optionally a sublayer adjacent to a backing layer. By providing the sublayer of the present invention, it is possible to improve adhesive properties between the support and either the image forming layer or the backing layer.

The sublayer comprises at least 1) a hydrophobic polymer latex and/or 2) a hydrophilic polymer having an OH group. Said hydrophobic polymer latexes may be employed without particular limitation as long as they are employed as hydrophobic polymer latexes in the present industrial field. For instance, employed may be acryl based latexes, active methylene based latexes, polyester based latexes, polyurethane based latexes, vinylidene chloride based latexes, styrene-diolefin polymer latexes, and the like. As hydrophobic latexes, materials shown below are preferred.

1. Hydrophobic polymer latexes having a glass transition temperature of from 50 to 80° C.
2. Acryl based polymer latexes
3. Active methylene based polymer latexes
4. Styrene-diolefin based polymer latexes
5. Vinylidene chloride based polymer latexes Hydrophobic polymer latexes are preferably incorporated in an amount of at least 50 percent by weight of the amount of binders incorporated into the sublayer, and more preferably incorporated in an amount of at least 70 percent by weight.

Polymer latexes listed in the aforementioned items 1 through 5 will now be described.

1. By employing a polymer latex having a glass transition temperature of from 50 to 80° C., the film forming properties of said latex is optimized so that it is also possible to minimize the deformation of the sublayer during heat development process, and it is possible to minimize peeling from the adjacent layer.

The glass transition temperature is determined by a method described in "Polymer Handbook", the third edition, edited by J. Brandrup and E. H. Immergut (John Wily & Sons. 1966) on pages III/139 to III/177.

The glass transition temperature of the copolymer, Tg(copolymer) in ° K is estimated by the following formula.

$$Tg(\text{copolymer})=v_1Tg_1+v_2Tg_2+v_3Tg_3++v_{nTgn}$$

In the formula, $Tg_i$ is a glass transition temperature of homopolymer of monomer (i) in ° K, and $v_i$ is mass fraction of monomer (i) in the polymer. Accuracy of the glass transition temperature obtained by the formula is within ±5° C.

2. Acryl Based Polymer Latexes

The acryl base polymer latexes as described in the present invention refer to latexes comprising as components acryl based monomers such as, for example, methacrylic acid, and acrylic acid, and esters or salts thereof, and acrylamide, and methacrylamide, and further refer to latexes having those as components in an amount of at least 5 percent by weight, and preferably at least 20 percent by weight.

The acryl based polymer latex can be prepared by emulsion polymerization. For example, it can be prepared by mixing for 3 to 8 hours at 30 to 100° C., preferably 60 to 90° C., employing water as the dispersant, 10 to 50 weight % of monomer with reference to the content of water, 0.05 to 5 weight % of polymerization initiator and 0.1 to 20 weight % of dispersing aid with reference to the content of the monomer. Conditions such as content of monomer and initiator, reaction temperature, reaction time can be widely modified.

As polymerization initiators, are cited exemplarily, water-soluble peroxide such as potassium persulfate, ammonium persulfate, water-soluble azobis compound such as 2,2'- azobis(2-amidinopropane)hydrochloride, or redox initiator which is combination of reducing agent such as a salt of $Fe^{2+}$, or sodium hydrogen sulfite with those cited above.

A water-soluble polymer is employed for the dispersion aid, and any of an anionic surfactant, a nonionic surfactant, a cationic agent or an amphoteric surfactant can be employed.

The number average particle diameter of said acryl based polymer latexes is most preferably from 0.01 to 0.8 μm, and those having the same from 0.005 to 2.0 μm are also preferably employed.

The acryl based polymer latex can be prepared by employing an acryl based monomer solely or in combination with other monomer (co-monomer) which is copolymerized with the acryl based monomer.

Listed as acryl based monomers are, for example, acrylic acid; methacrylic acid; acrylic acid esters such as, for example, alkyl acrylates (for example, methyl acrylate, ethyl acrylate, n-propyl acrylate, isopropyl acrylate, n-butyl acrylate, isobutyl acrylate, t-butyl acrylate, 2-ethylhexyl acrylate, cyclohexyl acrylate, phenyl acrylate, benzyl acrylate, phenyl ethyl acrylate, etc.), hydroxy containing acrylates (for example, 2-hydroxyethyl acrylate, 2-hydroxypropyl acrylate, etc.); methacrylic acid esters such as, for example, alkyl methacrylate (for example, methyl methacrylate, ethyl methacrylate, n-propyl methacrylate, isopropyl methacrylate, n-butyl methacrylate, isobutyl methacrylate, t-butyl methacrylate, 2-ethylhexyl methacrylate, cyclohexyl methacrylate, phenyl methacrylate, benzyl methacrylate, phenyl ethyl methacrylate, etc.), hydroxy containing alkyl methacrylates (for example, 2-hydroxyethyl methacrylate, 2-hydroxypropyl methacrylate, etc.); acrylamides; substituted acrylamides such as, for example, N-methylacrylamide, N-methylolacrylamide, N,N-dimethylolacrylamide, N-methoxymethylacrylamide, and the like; methacrylamide; substituted methacrylamides such as, for example, N-methylmethacrylamide, N-methylolmethacrylamide, N,N-dimethylolmethacrylamide, N-methoxymethylmethacrylamide, and the like; amino group substituted alkyl acrylates such as for example, N,N-diphenylaminoethyl acrylate; amino group substituted methacrylates such as, for example, N,N-diphenylaminoethyl methacrylate; epoxy group containing acrylate such as, for example, glycidyl acrylate; epoxy group containing methacrylates such as, for example, glycidyl methacrylate; acrylic acid salts such as, for example, sodium salts, potassium salts, ammonium salts; methacrylic acid salts such as, for example, sodium salts, potassium salts, ammonium salts. Said monomers may be employed in combination of two or more types. The monomers may be employed in combination of two or more types.

Example of the co-monomer includes monomers such as unsaturated dicarboxylic acids (for example, itaconic acid, maleic acid, fumaric acid, and the like), unsaturated dicarboxylic acid esters (for example, methyl itaconate, dimethyl itaconate, methyl maleate, dimethyl maleate, methyl fumarate, dimethyl fumarate, and the like), salts of said unsaturated dicarboxylic acids (for example, sodium salts, potassium salts, and ammonium salts), monomers having a sulfonic acid group and salts thereof (for example, styrenesulfonic acid), vinylsulfonic acids and salts thereof (such as sodium salts, potassium salts, and ammonium salts), acid anhydrides such as maleic anhydride, itaconic anhydride, and the like, vinyl isocyanate, allyl isocyanate, vinyl methyl ether, vinyl ethyl ether, vinyl acetate and the like. Said monomers may be employed in combination of two or more types.

3. Active Methylne Polymer Latex

The preferable examples of the structure of the active methylene polymer latex is represented by General Formula (I) described below:

General Formula (I)

$$-(A)_x-(B)_y-(C)_z-$$

wherein A represents a repeating unit derived from an ethylenically unsaturated monomer having an active methylene group represented by the Formula (2); B represents a repeating unit derived from an ethylenically unsaturated monomer having a glass transition point of 35 OC selected from the group consisting of acrylates, methacrylates, and maleates; and C represents a repeating unit derived from an ethylenically unsaturated monomer other than A and B. Further, x, y, and z each represent the percent by weight of a polymer, $5 \leqq x \leqq 60$, $5 \leqq y \leqq 90$, and x+y+x=100.

Formula (2)

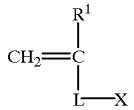

In the formula $R^1$ represents a hydrogen atom, an alkyl group having 1 to 4 carbon atoms or a halogen atom; L represents a single bond or a bivalent linkage group, such as one represented by the following formula:

$$-(L^1)m-(L^2)n-$$

wherein $L^1$ represents $-CON(R^2)-$, in which $R^2$ represents a hydrogen atom, an alkyl group having 1 to 4 carbon atoms or a substituted alkyl group having 1 to 6 carbon atoms, —COO—, —NHCO—, —OCO—,

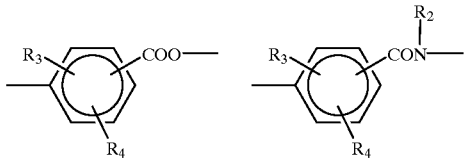

in which $R^3$ and $R^4$ independently represent a hydrogen atom, hydroxy, halogen atom, or an alkyl, alkoxy, acyloxy or aryloxy, each of which may be substituted or unsubstituted; $L^2$ represent a linkage group linking $L^1$ and X. The linkage group represented by $L^2$ is preferably represented by the following formula:

$$-[X^1-(J^1-X^2)p-(J^2-X^3)q-(J^3)r]s-$$

where $J^1$, $J^2$ and $J^3$, which may be the same or different, represent —CO—, $-SO_2-$, $-CON(R^5)-$, $-SO_2N(R^5)-$, $-N(R^5)-R^6-$, $-N(R^5)-R^6-N(R^7)-$, —O—, —S—, $-N(R^5)-CO-N(R^7)-$, $-N(R^5)-SO_2N(R^7)-$, —COO—, —OCO—, $-N(R^5)CO_2-$ or $-N(R^5)CO-$, in which $R^5$ represents a hydrogen atom, an alkyl group having 1 to 6 carbon atoms or substituted alkyl group having 1 to 6 carbon atoms; $R^6$ represents an alkylene group having 1 to 4 carbon atoms and $R^7$ represents a hydrogen atom, an alkyl group having 1 to 6 carbon atoms or substituted alkyl group having 1 to 6 carbon atoms);

p, q, r and s each 0 or 1; $X^1$, $X^2$ and $X^3$, which may be the same or different, each represents a straight-chained or branched alkylene, an aralkylene or a phenylene group, each of which has 1 to 10 carbon atoms and may be substituted or unsubstituted. Examples of the alkylene group include methylene, methylmethylene, dimethylmethylene, dimethylene, trimethylene, tetramethylene, pentamethylene, hexamethylene and decylmethylene; Examples of the aralkylene group include benzylidene; and examples of the phenylene group include p-phenylene, m-phenylene and methylphenylene.

X represents a univalent group containing an active methylene group, and preferred examples thereof include $R^8$—CO—$CH_2$—COO—, CN—$CH_2$—COO—, $R^8$—CO—$CH_2$—CO— or $R^8$—CO—$CH_2$—CON($R^5$)—, in which $R^5$ is the same as defined above, $R^8$ represents a substituted or unsubstituted alkyl group having 1 to 12 carbon atoms (e.g., methyl, ethyl, n-butyl, t-butyl, n-nonyl, 2-methoxyethyl, 4-phenoxybutyl, benzyl, 2-methanesulfonamidoethyl, etc.), substituted or unsubstituted aryl group (e.g., phenyl, p-methylphenyl, p-methoxyphenyl, o-chlorophenyl, etc.), substituted or unsubstituted alkoxy group (e.g., methoxy, ethoxy, methoxyethoxy, n-butoxy, etc.), substituted or unsubstituted cycloalkyloxy group (e.g., cyclohexyloxy), substituted or unsubstituted aryloxy group (e.g., phenoxy, p-methylphenoxy, o-chlorophenoxy, p-cyanophenoxy, etc.), and substituted or unsubstituted amino group (e.g., amino, methylamino, ethylamino, dimethylamino, butylamino, etc.).

Examples of an ethylenically unsaturated monomer having an active methylene group represented by A are shown below.

MN-1 2-acetoacetoxyethylmethacrylate
MN-2 2-acetoacetoxyethylacrylate
MN-3 2-acetoacetoxypropylmethacrylate
MN-4 2-acetoacetoxypropylacrylate
MN-3 2-acetoacetoamidoethylmethacrylate
MN-6 2-acetoaceto amido ethylacrylate
MN-7 2-cyanoacetoxyethylmethacrylate
MN-8 2-cyanoacetoxyethylacrylate
MN-9 N-(2-cyanoacetoxyethyl)acrylamide
MN-10 2-propionylacetoxyethylacrylate
MN-11 N-(2-propionylacetoxyethyl)methacrylamide
MN-12 N-4-(acetoacetoxybenzyl)phenylacrylamide
MN-13 ethylacryloylacetate
MN-14 methylacryloylacetate
MN-15 N-methacryloyloxymethylacetoacetoamide
MN-16 ethylmethacryloylacetoacetate
MN-17 N-allylcyanoacetoamide
MN-18 methylacryloylacetoacetate
MN-19 N-(2-methacryloyloxyethyl)cyanoacetoamide
MN-20 p-(2-acetoacetyl)ethylstyrene
MN-21 4-acetoacetyl-1-methacryloylpiperazine
MN-22 ethyl-(-acetoacetoxymethacrylate
MN-23 N-butyl-N-acryloyloxyethylacetoacetoamide
MN-24 p-(2-acetoacetoxy)ethylstyrene
MN-23 glycidylacrylate
MN-24 glycidylmethacrylate The ethylenically unsaturated monomer giving a repeating unit represented by B in the formula is a monomer which produces homopolymer having Tg of not more than 35° C., for example, alkylacrylate such as methylacrylate, ethylacrylate, n-butylacrylate, n-hexylacrylate, benzylacrylatet 2-etylhexylacrylate, iso-nonylacrylate and n-dodecylacrylate; alkylmethacrylate such as n-butylmethacylate, n-hexylmethacylate, 2-etylhexylmethacrylate, iso-nonylmethacrylate and n-dodecylmethacrylate.

Examples of the more preferable monomer are those produces homopolymer having Tg of not more than 10° C. Particular examples of the monomer includes alkyl acrylate having alkylene side chain containing two or more carbon atoms, such as ethylacrylate, n-butylacrylate, 2-ethylhexylmethacrylate, and iso-nonylmethacrylate; alkyl methacrylate having alkylene side chain containing six or more carbon atoms, such as n-hexylmethacylate, and 2-etylhexylmethacrylate.

Values of glass transition temperature of the above-mentioned polymers are described in "Polymer Handbook", the third edition, edited by J. Brandrup and E. H. Immergut (John Wily & Sons. 1989) on pages VI/209 to VI/277.

The repetition unit represented by C of Formula (1) represents the repetition unit other than A and B, that is, the repetition unit derived from the monomer from which is obtained single polymer through polymerization of which glass transition temperature is more than 35° C.

Exemplarily, the monomer represents acrylic acid ester and its derivative (for example, t-butylacrylate, phenylacrylate, 2-naphthylacrylate, etc.), methacrylic acid ester and its derivative (for example, methylmethacrylate, ethylmethacrylate, 2-hydroxyethylmethacrylate, benzylmethacrylate, 2-hydroxypropylmethacrylate, phenylmethacrylate, cyclohexylmethacrylate, cresylmethacrylate, 4-chlorobenzylmethacrylate, ethyleneglycoldimethacrylate, etc.), vinyl ester and its derivative (for example, vinylbenzoate, pivaloyloxyethylene, etc.), acrylamide and its derivative (for example, acrylamide, methylacrylamide, ethylacrylamide, propylacrylamide, butylacrylamide, tert-butylacrylamide, cyclohexylacrylamide, benzylacrylamide, hydroxymethylacrylamide, methoxyethylacrylamide, dimethylaminoethylacrylamide, phenylacrylamide, dimethylacrylamide, diethylacrylamide, β-cyanoethylacrylamide, diacetoneacrylamide, etc.), methacrylamide and its derivative (for example, methacrylamide, methylmethacrylamide, ethylmethacrylamide, propylmethacrylamide, butylmethacrylamide, tert-butylmethacrylamide, cyclohexylmethacrylamide, benzylmethacrylamide, hydroxymethylmethacrylamide, methoxyethylmethacrylamide, dimethylaminoethylmethacrylamide, phenylmethacrylamide, dimethylmethacrylamide, diethylmethacrylamide, β-cyanoethylmethacrylamide, etc.), styrene and its derivative (for example, styrene, methylstyrene, dimethylstyrene, trimethylstyrene, ethylstyrene, iso-propylstyrene, methoxystyrene, acetoxystyrene, chlorostyrene, dichlorostyrene, bromostyrene, vinylbenzoic acid methyl ester, etc.), divinylbenzene, acrylonitrile, methacrylonitrile, N-vinylpyrrolidone, N-vinyloxazolidone, vinylidene chloride, phenylvinylketone, etc.

A monomer having anionic functional group such as carboxylic group and sulfonic acid group, disclosed in Japanese Patent Publication Open to Public Inspection Nos. 60-15935, 53-28086, and U.S. Pat. No. 3,700,456 can be co-polymerized for the purpose of improving the stability of latex in the polymer represented by Formula (I) of the invention.

Example of the monomer includes; acrylic acid; methacrylic acid; itaconic acid, maleic acid; monoalkyl itaconate such as methyl itaconate and monoethyl itaconate; monoalkyl maleate such as monomethyl maleate; citraconic acid; styrene sulfonic acid; vinylbenzyl sulfonic acid; vinyl sulfonic acid; acryloyloxyalkyl sulfonic acid such as acryloyloxymethyl sulfonic acid, acryloyloxyethyl sulfonic acid and acryloyloxypropyl sulfonic acid; methacryloyloxyalkyl sulfonic acid such as methacryloyloxymethyl sulfonic acid, methacryloyloxyethyl sulfonic acid and methacryloyloxypropyl sulfonic acid; acrylamide alkyl sulfonic acid such as 2-acrylamide-2-methylethane sulfonic acid, 2-acrylamide-2-methylpropane sulfonic acid, and 2-acrylamide-2-methylbutane sulfonic acid; methacrylamide alkyl sulfonic acid such as 2-methcrylamide-2-methylethane sulfonic acid, 2-methacrylamide-2-methylpropane sulfonic acid, and 2-methacrylamide-2-methylbutane sulfonic acid. These acids may be substituted by its salt of alkali metal such as sodium, potassium etc., or ammonium.

The above-described monomer containing an anionic functional group can be optionally used irrespective of the glass transition temperature of its homopolymer. It is preferably used in an amount of 0.5 to 20% by weight, and more preferably 1 to 10% by weight, based on the total weight of a polymer.

In the invention, the above-described polymer containing an active methylene group preferably exhibits a glass transition temperature of not less than −60° C., and more preferably nor less than −40° C.

The polymer containing an active methylene group used in the invention (hereinafter, also denoted as the active methylene group containing polymer) is preferably prepared through emulsion polymerization. The dispersion particle size is not specifically limited, but preferably within the range of 0.01 to 1.0 $\mu$m. In the emulsion polymerization used in the invention, an aqueous soluble polymer is preferably used as an emulsifying agent. In addition thereto, a monomer is emulsified in a mixed solvent of water and a water-miscible organic solvent (e.g., methanol, ethanol, acetone, etc.) and using a radical polymerization initiator, polymerization is conducted generally at a temperature of 30 to 100° C., and preferably 40 to 90° C. The proportion of the water-miscible solvent is 0 to 100%, and preferably 0 to 50% by weight, based on water.

Polymerization reaction is carried out using a radical polymerization initiator of 0.05 to 5% by weight and optionally an emulsifying agent of 0.1 to 10% by weight. Examples of the radical polymerization initiator include azo-bis compounds, peroxides, hydroperoxides and redox solvents, such as potassium persulfate, ammonium persulfate, t-butyl peroctanoate, benzoyl peroxide, isopropyl carbonate, 2,4-dichlorobenzyl peroxide, methyl ethyl ketone peroxide, cumene hydroperoxide, dicumyl peroxide, 2,2'-azobis isobutylate, 2,2'-azobis(2-amidinopropane)hydrochloride, and a combination of potassium sulfite and sodium hydrogen sulfite.

Anionic, cationic, amphoteric or nonionic surfactants may be used as an emulsifying agent at the time when using the aqueous-soluble polymer. The surfactant may be used in an amount of 0 to 100%, preferably 0 to 25%, and more preferably 0 to 10% by weight, based on the aqueous soluble polymer. Preferred examples of the surfactant include sodium laurate, sodium dodecylsulfate, sodium 1-octoxycarbonylmethyl-1-octoxycarbonylmethanesulfonate, sodium dodecylnaphthalenesulfonate, sodium dodecylbenzenesulfonate, sodium dodecylphosphate, cetyltrimethylammonium chloride, dodecytrimethyleneammonium chloride, N-2-ethylhexylpyridinium chloride, polyoxyethylene nonylphenyl ether, and polyoxyethylene sorbitan lauric acid ester.

The emulsifying agent may be used in combination thereof at a moment of using the aqueous soluble polymer described below. The emulsifying agent can be used in an amount of 0 to 100%, and preferably 0 to 25% by weight, based on the aqueous soluble polymer.

In preparation of the active methylene group-containing polymer through emulsion polymerization, an aqueous soluble polymer is preferably used. Aqueous soluble polymers used in the invention include aqueous soluble natural polymers and aqueous soluble synthetic polymers, each of which contains, in its molecule, a water-solubilizing anionic, cationic or nonionic group. Preferred examples of the anionic group include carboxylic acid and its salts, sulfonic acid and its salt, phosphoric acid and its salt; preferred examples of the cationic group include tertiary amine and its ammonium salt; and preferred examples of the nonionic group include hydroxy, amido group, methoxy group, alkyleneoxide group such as oxyethylene and heterocyclic group such as pyrrolidone group. Of the aqueous soluble synthetic polymers, anionic or nonionic polymers are preferred, and anionic polymers are more preferred. Polymers containing a sulfonate are still more preferred, such as polystyrenesulfonate and a polymer containing a conjugated diene type sulfonate. The aqueous-soluble polymer can be used in combination thereof.

The aqueous soluble polymer used in the preparation of the active methylene group-containing polymer through emulsion polymerization include aqueous-soluble natural or semi-synthetic polymer, such as alginic acid and its salt, dextran, dextran sulfate, glycogen, arabic gum, albumin, agar, starch derivatives, carboxymethyl cellulose and its salt, hydroxycellulose, cellulose sulfuric acid ester, and their derivatives.

Exemplary examples of the aqueous soluble polymer used in the preparation, through emulsion polymerization, of the polymer according to the invention are shown below.

SP-1

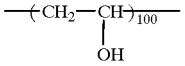

SP-2

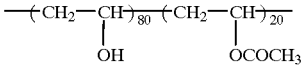

SP-3

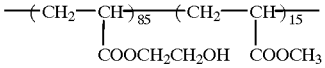

SP-4

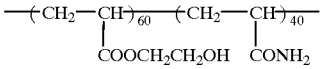

SP-5

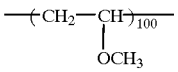

SP-6

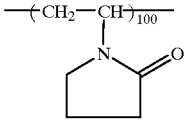

SP-7

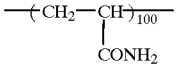

SP-8

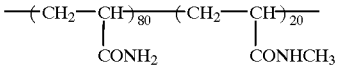

-continued
SP-9
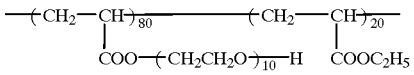
SP-10
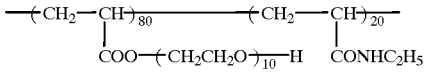
SP-11
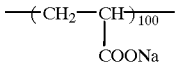
SP-12
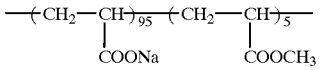
SP-13
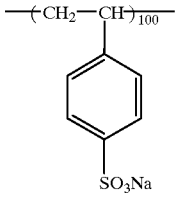
SP-14
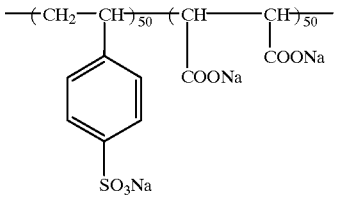
SP-15
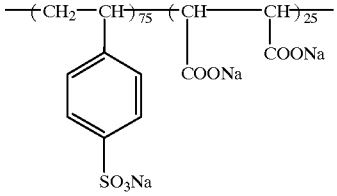
SP-16
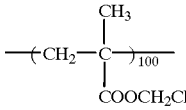
SP-17
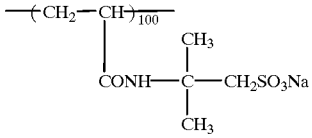
SP-18
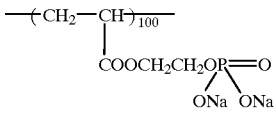
SP-19
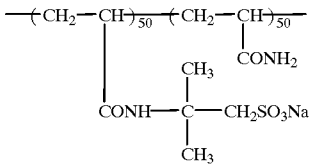
-continued
SP-20
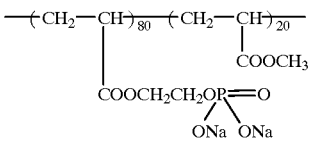
SP-21
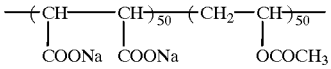
SP-22
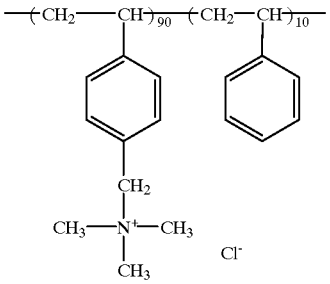
SP-23
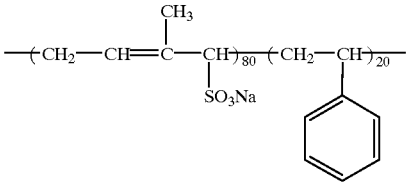
SP-24
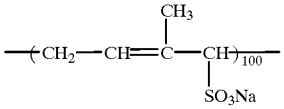
SP-25
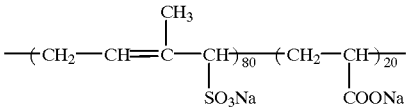
SP-26
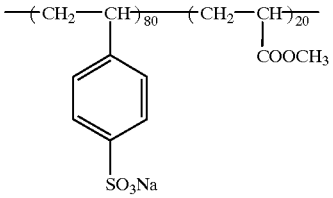
SP-27
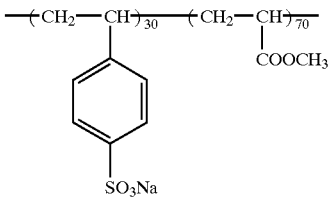
SP-28
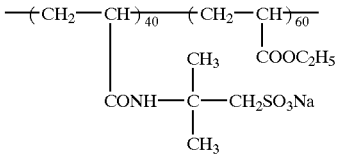

-continued

| | |
|---|---|
| Dextran sodium sulfate | SP-29 |
| Dextran | SP-30 |
| Sodium alginate | SP-31 |

In emulsion polymerization are readily variable a polymerization initiator, the concentration, polymerization temperature and reaction time. Emulsion polymerization reaction may be initiated by adding an initiator to a reaction vessel containing monomer(s), a surfactant, an aqueous soluble polymer and a medium. Alternatively, polymerization may be carried out with adding a part or all of the components.

In the polymer represented by formula (1), the active methylene-containing monomer represented by A or polymer latex are described with respect to the kind and synthetic method in U.S. Pat. No. 3,459,790, 3,619,195, 3,929,482 and 3,700,456; West German Patent 2,442,165; European Patent 13,147; and JP-A 50-7362 and 50-146331.

Values of glass transition temperature of the above-mentioned polymers are described in "Polymer Handbook", the third edition, edited by J. Brandrup and E. H. Immergut (John Wily & Sons. 1975) on pages III-139 to III-192, and it is estimated by the following formula in the case of co-polymer.

$$1/Tg=a_1/Tg_1+a_2/Tg_2+a_2/Tg_2++a_n/Tg_n.$$

In the formula, Tgn is a glass transition temperature of homopolymer of monomer (n), and $a_n$ is mass fraction of monomer (n) in the polymer.

Exemplary examples of active methylene group containing polymer compounds employed in the invention are shown below. The proportion of each copolymerizing component is also shown in Table 1.

TABLE 1

| Compound | Monomer A (wt. ratio *1) | Monomer B (wt. ratio) | Monomer C (wt. ratio) | Aqueous-soluble Polymer/ Surfactant |
|---|---|---|---|---|
| Lx-1 | MN-1 (0.4) | BA (0.2) | St (0.4) | SP-22, S-2 |
| Lx-2 | MN-1 (0.6) | BA (0.1) | St (0.4) | SP-22, S-2 |
| Lx-3 | MN-1 (0.2) | BA (0.3) | St (0.5) | SP-22, S-2 |
| Lx-4 | MN-1 (0.4) | AIN (0.3) | CHMA (0.3) | SP-22, S-2 |
| Lx-5 | MN-1 (0.4) | EA (0.2) | MMA (0.4) | SP-22, S-2 |
| Lx-6 | MN-1 (0.4) | EA (0.2) | St (0.4) | SP-22, S-2 |
| Lx-7 | MN-1 (0.4) | VAc (0.4) | EMA (0.4) | SP-22, S-2 |
| Lx-8 | MN-2 (0.4) | BA (0.2) | St (0.4) | SP-22, S-2 |
| Lx-9 | MN-1 (0.2) GMA (0.2) | BA (0.3) | St (0.3) | SP-22, S-2 |
| Lx-10 | MN-1 (0.4) | AIN (0.3) | St (0.3) | SP-22, S-2 |
| Lx-12 | MN-1 (0.4) | AIN (0.3) | St (0.3) | SP-1, S-2 |
| Lx-13 | MN-1 (0.4) | AIN (0.3) | St (0.3) | SP-2, S-2 |
| Lx-14 | MN-1 (0.4) | AIN (0.3) | St (0.3) | SP-6, S-2 |
| Lx-15 | MN-1 (0.4) | AIN (0.3) | St (0.3) | SP-7, S-2 |
| Lx-16 | MN-1 (0.4) | AIN (0.3) | St (0.3) | SP-8, S-2 |
| Lx-17 | MN-1 (0.4) | AIN (0.3) | St (0.3) | SP-13, 5-2 |
| Lx-18 | MN-1 (0.4) | AIN (0.3) | St (0.3) | SP-25, S-2 |
| Lx-19 | MN-1 (0.4) | AIN (0.3) | St (0.3) | SP-26, S-2 |
| Lx-20 | MN-1 (0.4) | AIN (0.3) | St (0.3) | S-2 |
| Lx-21 | MN-1 (0.4) | BA (0.2) | St (0.4) | S-2 |
| Lx-22 | MN-1 (0.4) AA (0.05) | BA (0.55) | | SP-22, S-2 |

*1 proportion by weight of a copolymerizing component represented by monomer A of formula (1)

TABLE 1-continued

| Compound | Monomer A (wt. ratio *1) | Monomer B (wt. ratio) | Monomer C (wt. ratio) | Aqueous-soluble Polymer/ Surfactant |
|---|---|---|---|---|

The aqueous-soluble polymer and surfactant were used as protective colloid at the time of emulsion polymerization, in which S-2 represents sodium dodecylbenzenesulfonate, and the proportion of solid components of the latex was 30%.

In the Table, the term, BA, St, AA, EA, MMA, EMA, VAc, AIN, CHMA and GMA each represent n-butyl acrylate, styrene, acrylic acid, ethyl acrylate, methyl methacrylate, ethyl methacrylate, vinyl acetate, iso-nonyl acrylate, cyclohexylmethacrylate and glycidyl methacrylate, respectively.

The content of the polymer containing an active methylene group in an adhesive composition provided on a film or in a sublayer of a photographic material is preferably 10 to 90% solid, and more preferably 30 to 70% solid by weight. The polymer containing an active methylene group used in the invention is preferably a polymer latex. Herein, the polymer latex refers to a polymeric component contained in the latex.

4. Styrene-Diolefin Based Polymer Latex

The styrene-diolefin based polymer latex employed in the invention is preferably a diolefin based rubber material. Diolefin monomer is a monomer having two double bond in one molecule, and it may be an aliphatic unsaturated hydrocarbon or one having a ring structure.

Listed as diolefin monomers, which form styrenes-diolefin based copolymers of the present invention may be conjugated dienes such as butadiene, isoprene, chloroprene, and the like; non-conjugated dienes such as 1,4-pentadiene, 1,4-hexadiene, 3-vinyl-1,5-hexadiene, 1,5-hexadiene, 3-methyl-1,5-hexadiene, 3,4-dimethyl-1,5-hexadiene, 1,2-divinylcyclobutane, 1,6-heptadiene, 3,5-diethyl-1,5-heptadiene, 4-cyclohexyl-1,6-heptadiene, 3-(4-pentenyl)-1-cyclopentane, 1,7-octadiene, 1,8-nonadiene, 1,9-decadiene, 1,9-octadecadiene, 1-cis-9-cis-1,2-octadecatriene, 1,10-undecadiene, 1,,1-dodecadiene, 1,12-tridecadiene, 1,13-tetradecadiene, 1,14-pentadecadiene, 1,15-hexadecadiene, 1,17-octadecadiene, 1,21-docosadiene, and the like; cyclohexanediene, cyclobutanediene, cyclopentadiene, cyclohepadiene, and the like.

Of these, a conjugated dien such as butadiene, isoprene, and chloroprene is preferred, and butadiene is more preferred.

Further, styrenes, which are employed as other monomers which form styrenes-diolefin based copolymers, include styrene and styrene derivatives. Listed as styrene derivatives may be, for example, methylstyrene, dimethylstyrene, ethylstyrene, diethylstyrene isopropylstyrene, butylstyrene, hexylstyrene, cyclohexylstyrene, decylstyrene, chloromethylstyrene, trifluoromethylstyrene, ethoxymethylstyrene, acetoxymethylstyrene, methoxystyrene, 4-methoxy-3-methylstyrene, dimethoxystyrene, chlorostyrene, dichlorostyrene, trichlorostyrene, tetrachlorostyrene, trichlorostyrene, tetrachlorostyrene, pentachlorostyrene, bromostyrene, dibromostyrene, iodostyrene, fluorostyrene, trifluorostyrene, 2-bromo-4-trifluoromethylstyrene, 4-fluoro-3-trifluoromethylstyrene, vinylbenzoic acid, vinylbenzoic acid methyl ester, divinylbenzene, 1,5-hexadien-3-yn, hexatrien and the like.

The content of diolefin monomers in styrenes-diolefin based copolymers employed as sublayer components of the present invention is generally between 10 and 60 percent by weight with respect to the total copolymers, and is most preferably between 14 and 40 percent by weight, while the content of styrenes is preferably between 40 and 70 percent by weight with respect to the total copolymers. Further, said styrenes-diolefin based copolymers may comprise monomers comprising a third component. Listed as said third components may be, for example, acrylic acid esters or methacrylic acid esters, and chlorine atom-containing monomer such as vinyl esters, vinyl chloride. Monomers having two or more vinyl group, acryloyl group, methacryloyl group and allyl group can be copolymerized.

Examples of these include divinyl ether, divinyl sulfon, diallylphthalate, diallylcarbinol, diethyleneglycolmethacrylate, trimethylolpropanetrimethacrylate, trimethylolpropanedimethacrylate, etc.

Polymer obtained by the polymerization is gelled and insoluble in any solvent since one of the component dien monomers cross-linked by itself.

Polymerization methods for these polymers, for example, include an emulsion polymerization method, a solution polymerization method, a bulk polymerization method, a suspension polymerization method, a radiation polymerization method, and the like. However, a latex-like polymer, which is prepared utilizing the emulsion polymerization, is preferred. Further, when crosslinkable monomers are employed, the gel forming ratio of latex is preferably from 50 to 95 percent by weight. The gel as described herein refers to a state in which copolymerizing components are subjected to three-dimensional polymerization. When a copolymer, having the composition as shown in the present invention, is prepared by three-dimensional polymerization, its solubility in solvents varies depending on the degree of said three-dimensional polymerization. Namely, as the three-dimensional polymerization proceeds, the solubility decreases. Accordingly, the degree of three-dimensional polymerization of said gel is estimated based on its solubility. Since the solubility varies depending on employed solvents, the degree of three-dimensional polymerization of said gel naturally varies depending on each solvent. However, in the present invention, the gel, as described in the present invention, refers to a state of three-dimensional polymerization and further to one having the degree of three-dimensional polymerization, which is insoluble in purified tetrahydrofuran at 20° C. during 48-hour immersion.

When said solution polymerization is employed, polymers are obtained by polymerizing a monomer mixture having suitable concentration in solvents (commonly, a mixture in an amount of no more than 40 percent by weight with respect to solvents, and preferably from 10 to 25 percent by weight) at temperatures ranging from 10 to 200° C., preferably from 30 to 120° C. for 0.5 to 48 hours, and preferably 2 to 20 hours in the presence of initiators.

Employed as said solvents may be those which dissolve said monomer mixture, which, for example, include water, methanol, ethanol, dimethylsulfoxide, dimethylformamide, dioxane, or mixed solvents consisting of two or more types thereof.

Employed as initiators may be those which are soluble in solvents used in polymerization, which, for example, include organic solvent based initiators such as benzoyl peroxide, azobisisobutyronitrile (AIBN), di(t)butyl peroxide, and the like;, water-soluble initiators such as potassium persulfate, 2,2'-azobis-(2-aminopropane)-hydrochloride, and the like; redox based initiators which are combined these with reducing agents such as $Fe^{2+}$ salts, sodium hydrogensulfite, and the like; and the like.

When said emulsion polymerization is employed, polymers are obtained in such a manner that water is employed as the dispersion medium and employing monomers in an amount of from 10 to 50 percent by weight with respect to water, and polymerization initiators in an amount of from 0.05 to 5 percent by weight with respect to said monomers, polymerization is accomplished at temperatures ranging from 30 to 100° C., preferably from 60 to 90° C. for 3 to 8 hours while stirring. It is possible to readily and widely vary the concentration of monomers, the amount of initiators, the reaction temperatures, the reaction time, and the like.

As dispersing agents, water-soluble polymers are employed, and it is possible to employ any of the anionic surface active agents, nonionic surface active agents, cationic surface active agents, and amphoteric surface active agents.

5. Vinylidene Chloride Based Polymer Latexes

In the present invention, vinylidene chloride latexes may be comprised of vinylidene chloride (comprising vinylidene chloride as the major component) in an amount of from 50 to 99.9 mole percent, vinyl or acryl based monomers having a carboxyl group in an amount of from 0.1 to 8 mole percent, and in addition, monomers more than the third component. Listed as vinyl or acryl based monomers having a carboxyl group, which are the second component, may be acids such as acrylic acid, methacrylic acid, maleic acid (copolymerized in the form of maleic anhydride and subjected to ring-opening during polymerization or at the end of polymerization), itaconic acid, and salts thereof.

The water-soluble polymers, having an OH group, employed in the present invention refer to polymers which have an OH group in their molecules, a number average molecular weight of from 1,000 to 1,000,000, and preferably from 3,000 to 200,000, or a degree of polymerization of at least 50. The term "water-soluble" of water-soluble polymers as described in the present invention refers to cases in which at least 1 g of said polymer is dissolved in 1 liter of water, irrespective of temperature.

Cited as examples of such water-soluble polymers may be synthetic polymers such as polyvinyl alcohol and derivatives thereof, polymers prepared by copolymerizing monomers having a hydroxy (-OH) group such as polyethylene glycol, hydroxyethyl methacrylate, and the like, polymers prepared by copolymerizing monomers having a polyethylene oxide chain or polypropylene oxide ethylene chain having a hydroxy (-OH) group at the terminal, and natural polymers such as nonelectrolyte polysaccharides such as starch, galactomannan, and celluloses.

Of these polymers, preferably listed may be polyvinyl alcohol and derivatives thereof, ethylene copolymerized polyvinyl alcohol, modified polyvinyl alcohol which are subjected to partial butylation to be water-soluble, and the like.

In addition, of these polymers, preferred water-soluble polymers having an OH group include polyvinyl alcohols and/or polymers having polyvinyl alcohol units. Said polyvinyl alcohols commonly have a degree of polymerization of from 100 to 100,000, preferably from 300 to 10,000, and preferably have a degree of saponification of at least 60. Further, regarding said polymers having vinyl alcohol units, listed as copolymerizing components vinyl acetate based polymers prior to saponification may be vinyl compounds such as ethylene, propylene, and the like; acrylic acid esters (for example, t-butyl acrylate, phenyl acrylate, 2-naphthyl acrylate, and the like); methacrylic acid esters (for example, methyl methacrylate, ethyl methacrylate, 2-hydroxyethyl methacrylate, benzyl methacrylate, 2-hydroxypropyl methacrylate, phenyl methacrylate, cyclohexyl methacrylate, cresyl methacrylate, 4-chlorobenzyl methacrylate, ethylene glycol dimethacrylate, and the like); acryl amides (for instance, acrylamide, methylacrylamide, ethylacrylamide, propylacrylamide, butylacrylamide, tert-butylacrylamide, cyclohexylacrylamide, benzylacrylamide, hydroxymethylacrylamide, methoxyethylacrylamide, dimethylaminoethylacrylamide, phenylacrylamide, dimethylacrylamide, diethylacrylamide, β-cyanoethylacrylamide, diacetoneacrylamide, and the like); methacrylamides (for example, methacrylamide, methylmethacrylamide, ethylmethacrylamide, propylmethacrylamide, butylmethacrylamide, tert-butylmethacrylamide, cyclohexylmethacrylamide, benzylmethacrylamide, hydroxymethylmethacrylamide, methoxyethylmethacrylamide, dimethylaminoethylmethacrylamide, phenylmethacrylamide, dimethylmethacrylamide, diethylmethacrylamide, β-cyanoethylmethacrylamide, and the like); styrenes (for example, styrene, methylstyrene, dimethylstyrene, trimethylenestyrene, ethylstyrene, isopropylstyrene, chlorostyrene, methoxystyrene, acetoxystyrene, chlorostyrene, dichlorostyrene, bromostyrene, methyl vinylbenzoate, and the like; divinylbenzene, acrylonitrile, methacrylonitrile, N-vinylpyrrolidone, N-vinyloxazolidone, vinylidene chloride, phenyl vinyl ketone, and the like. Of these, ethylene copolymerized polyvinyl alcohol is preferred. Water-soluble polymers are comprised of polyvinyl alcohol units in their molecules in an amount of at least 50 percent by mole ratio, and preferably in an amount of no more than 80 percent. Further, the sublayer is comprised of the water-soluble polymers of the present invention in an amount of from 40 to 100 percent by weight ratio and preferably in an amount of at least 70 percent.

These water-soluble polymers may be employed individually or in combination of two or more types. Further, said polymers may be employed in combination with polymers other than those of the present invention, ionic water-soluble polymers, and water dispersible polymers such as latexes. Specifically, butyral resinous particles having a number average particle diameter of from 50 to 1,000 nm, and preferably from 80 nm to 200 nm are preferably incorporated. The added amount of other polymers in the sublayer is commonly from 2 to 40 percent by weight with respect to the weight of water-soluble polymers, and is preferably from 5 to 20 percent by weight. Methods for forming butyral resinous particles are not limited. For example, it is possible to form those employing aqueous butyral resins.

The aqueous butyral resins, as described herein, are those which are obtained by plasticizing butyral resins employing plasticizers, organic solvents, and the like, and subsequently dispersing and emulsifying the resulting mixture into water employing surface active agents. In the sublayers of the present invention, one in which said water-soluble polymers having an OH group is most preferred from the viewpoint that peeling from the adjacent layer is readily carried out while adhesive properties are maintained.

The sublayer of the present invention may be employed on one surface or both surfaces of the support.

The sublayer of the present invention may be comprised of one layer, or may be comprised of two or more layers on one surface. In the present invention, said water-soluble polymers having an OH group are preferably incorporated into the top sublayer adjacent to the photosensitive layer, or into the backing layer since more pronounced effects are obtained.

When the sublayer of the present invention is comprised of two or more layers, the sublayer adjacent to the subbed support is preferably a sublayer obtained by applying a composition comprising polymer latexes. Listed as said polymer latexes may be those in the aforementioned items 1. through 5.

At least one of the sublayers of the present invention may be an electrically conductive layer. The electrically conductive layer, as descried herein, refers to the layer which has a surface resisitivity of no more than $10^{12}$ ohm-cm. Among said sublayers, the position of the electrically conductive layer is not particularly specified. Employed as electrically conductive layers may be metal oxide, such as tin oxide and the like, based electrically conductive layers, ionic polymer based electrically conductive layers, π electron based polymer electrically conductive layers and the like, which are materials known in the art for use in silver halide photosensitive photographic materials which are subjected to wet type photographic processing.

The thickness of these sublayers is not particularly limited, however the thickness of each layer is preferably from 0.01 to 20 μm.

If desired, said sublayers may comprise crosslinking agents, surface active agents, dyes, fillers, and the like.

The total dried layer thickness of sublayers is preferably from 0.05 to 2 μm, more preferably from 0.1 to 1 μm, and is more preferably from 0.1 to 0.5 μm.

The coated amount of coating compositions of the present invention is preferably from 0.01 to 10 ml per $m^2$ in terms of solid volume, and is most preferably from 0.1 to 3 ml.

Drying conditions are commonly from 120 to 200° C. as well as from 10 seconds to 10 minutes.

If desired, coating composition of the present invention may comprise surface active agents, swelling agents, matting agents, cross-over dyes, antihalation dyes, pigments, antifoggants, antiseptics, and the like. Employed as swelling agents are phenol, resorcin, cresol, chlorophenol, and the like, and the added amount may be from 1 to 10 g per liter of the coating composition of the present invention. Matting agents are preferably silica, polystyrene balls, methyl methacrylate balls and the like, having a diameter of from 0.1 to 10 μm.

Various types of coating methods are available such as dip coating, air knife coating, flow coating, or extrusion coating, employing the type of hopper described in U.S. Pat. No. 2,681,294. In addition, an extrusion coating method, a slide coating method, and a curtain coating method are acceptable which are described on pages 399 to 734 of Stephan F. Kister, M. Schwezer, "Liquid Film Coating" (published by Chapman & Hall Co., 1997). Further, if desired, at least two layers may be simultaneously coated employing methods described in U.S. Pat. Nos. 2,761,791, 3,508,947, 2,941,898, and 3,526,528, and on page 253 in Yuji Harazaki, "Coating Kogaku (Coating Engineering)" (published by Sakura Shoten, 1973).

The method for separating the emulsion layer from the support in the heat developable photosensitive material of the present invention is not particularly limited, as long as wet type processing is utilized. The heat developable photosensitive material of the present invention is immersed in an aqueous alkaline solution, which makes it possible to peel the emulsion layer from the support under an application of suitable force.

Binders employed in the photosensitive layer, interlayer, and backing layer, which are applied onto the sublayer of the present invention, are not particularly limited. Suitable binders are transparent or translucent, and are commonly colorless, and include natural polymers, synthetic resins, polymers and copolymers. In addition, also included are film forming media such as, for example, gelatin, gum Arabic, poly(vinyl alcohol), hydroxyethyl cellulose, cellulose acetate, cellulose acetate butyrate, polyvinyl(pyrrolidone), casein, starch, poly(acrylic acid), poly(methylmethacrylic acid), poly(vinyl chloride), poly(methacrylic acid), copoly (styrene-maleic anhydride), copoly(styrene-acrylonitrile), copoly(styrene-butadiene), poly(vinyl acetals) (for example, poly(vinyl formal), and poly(vinyl butyral), poly(esters), poly(urethanes), phenoxy resins, poly(vinylidene chloride), poly(epoxyamides), poly(carbonates), poly(vinyl acetate), cellulose esters, and poly(amides). These may be hydrophilic or hydrophobic.

Binders, which are employed in the photosensitive layer of the photothermographic dry imaging material according to the present invention, are preferably polyvinyl acetals, and are most preferably polyvinyl butyral. Further, binders, which are employed in non-photosensitive layers such as an upper layer as well as an bottom layer, especially a protective layer, a back coat layer, and the like, are preferably cellulose esters having a relatively high softening temperature, especially polymers such as triacetyl cellulose, cellulose acetate butyrate, and the like. Further, if desired, said binders may be employed in combination of two or more types.

Such binders are commonly employed in the range of an effective amount so that the functions of said binders are achieved. It is possible for an ordinary person in the art to readily determine the range of effective amount. For example, when organic silver salts are held in a photosensitive layer, the ratio of binders to said organic silver salts is preferably in the range from 15:1 to 1:2, and is most preferably in the range from 8:1 to 1:1. Namely, the amount of the binder in the photosensitive layer is preferably from 1.5 to 6 $g/m^2$, and is more preferably from 1.7 to 5 $g/m^2$. When it is less than 1.5 $g/m^2$, the density of unexposed areas markedly increases so that the resulting products are occasionally commercially unviable.

Supports employed in the present invention are optional. However, polyester supports are preferably employed.

The polyester of polyester supports employed in the present invention refers to one obtained by condensation polymerization of diols with dicarboxylic acids. Representative dicarboxylic acids include terephthalic acid, isophthalic acid, phthalic acid, naphthalenedicarboxylic acid, adipic acid, sebacic acid, and the like. Further, representative diols include ethylene glycol, trimethylene glycol, tetramethylene glycol, cyclohexanedimethanol, and the like. Specific examples of said diols include polyethylene terephthalate, polyethylene-p-oxybenzoate, poly-1,4-cyclohexylenediethylene terephthalate, polyethylene-2,6-naphthalene dicarboxylate, and the like. In the case of the present invention, polyethylene terephthalate and polyethylene naphthalate are particularly preferred. Said polyethylene terephthalate film exhibits excellent water resistance, durability, and chemical resistance, and the like.

Said polyester may be either a homopolyester or a copolyester. Listed as copolymerization components may be diol components such as diethylene glycol, neopentyl glycol, polyalkylene glycol, and the like, as well as dicarboxylic acid components such as adipic acid, sebacic acid, phthalic acid, 2,6-naphthalenedicarboxylic acid, 5-sodiumsulfoisophthalic acid and the like.

In the present invention, said polyester supports may be comprised of fine particles of calcium carbonate, non-crystalline zeolite particles, anatase type titanium dioxide, calcium phosphate, silica, kaolin, talc, clay, and the like. The added amount of these particles is preferably from 0.0005 to 25 parts by weight with respect to 100 parts by weight of the polyester composition In addition, other than said fine particles, it is possible to utilize fine particles deposited through the reaction of catalyst residues with phosphorous compounds in a polyester polymerization condensation reaction system. Listed as fine deposited particles may be, for example, those comprised of calcium, lithium, and phosphorous compounds or those comprised of calcium, magnesium and phosphorous compounds. The content of these particles in polyester is preferably from 0.05 to 1.0 part by weight with respect to 100 parts by weight of the polyester.

Further, various types of additives known in the art, such as, for example, antioxidants, dyes, and the like, may be incorporated into said polyester supports.

Still further, the thickness of polyester supports is preferably from 10 to 250 $\mu$m, and is more preferably from 15 to 200 $\mu$m. It is not preferred that the thickness be no more than the lower limit because said supports do not exhibit sufficient mechanical strength as the film. It is also not preferred that the thickness be greater than the upper limit because said supports do not exhibit enough runability.

In order to decrease core set curl, as described in Japanese Patent Publication Open to Public Inspection No. 51-16358, said polyester supports may be subjected to thermal treatment in the temperature range of no more than the glass transition temperature for 0.1 to 1,500 hours after casting.

In order to improve the adhesive properties of said supports, if desired, polyester supports may be subjected to surface treatments, known in the art, such as chemical treatments (described in Japanese Patent Publication Nos. 34-11031, 38-22148, 40-2276, 41-16423, and 44-5116); chemical and mechanical surface roughing treatments (described in Japanese Patent Publication Nos. 47-19068 and 55-5104); corona discharge treatments (described in Japanese Patent Publication No. 39-12838, and Japanese Patent Publication Open to Public Inspection Nos. 47-19824 and 48-28067); flame treatments (described in Japanese Patent Publication No. 40-12384 and Japanese Patent Publication Open to Public Inspection No. 48-85126); ultraviolet ray treatments (described in Japanese Patent Publication Nos. 36-18915, 37-14493, 43-2603, 43-2604, and 52-25726); high frequency treatments (described in Japanese Patent Publication No. 49-10687); glow discharge (described in Japanese Patent Publication No. 37-17682); in addition, active plasma treatments and laser treatments. It is preferred that the contact angle of said support surface with respect to water be adjusted to no greater than 58 degrees employing these treatments, as described in Japanese Patent Publication No. 57-487.

Further, said polyester supports may be either transparent or opaque, and may be tinted.

Silver halide grains of photosensitive silver halide in the present invention work as a light sensor. In order to minimize translucence after image formation and to obtain excellent image quality, the less the average grain size, the more preferred, and the average grain size is preferably less than 0.1 $\mu$m; is more preferably between 0.01 and 0.1 $\mu$m, and is most preferably between 0.02 and 0.08 $\mu$m. The average grain size as described herein denotes an average edge length of silver halide grains, when they are so-called regular crystals of cube or octahedron. Furthermore, when grains are not regular crystals, for example, spherical, cylindrical, and tabular grains, the grain size refers to the diameter of a sphere having the same volume as the silver grain.

Furthermore, silver halide grains are preferably monodisperse grains. The monodisperse grains as described herein refer to grains having a monodispersibility obtained by the formula described below of less than 40 percent; more preferably less than 30 percent, and most preferably between 0.1 and 20 percent.

Monodispersibility=(standard deviation of grain diameter)/(average of grain diameter)×100

In the present invention, it is preferred that the silver halide grains have an average grain size of 0.1 μm or less and is monodispersed, whereby the graininess of the image is improved.

The silver halide grain shape is not particularly restricted and preferred, in which a high ratio occupying a Miller index (100) plane is preferred. This ratio is preferably at least 50 percent; is more preferably at least 70 percent, and is most preferably at least 80 percent. The ratio occupying the Miller index (100) plane can be obtained based on T. Tani, J. Imaging Sci., 29, 165 (1985) in which adsorption dependency of a (111) plane and a (100) plane is utilized.

Furthermore, another preferred silver halide shape is a tabular grain. The tabular grain as described herein is a grain having an aspect ratio represented by r/h of at least 3, wherein r represents a grain diameter in μm obtained as the square root of the projection area, and h represents thickness in μm in the vertical direction.

Of these, the aspect ratio is preferably between 3 and 50. The grain diameter is preferably not more than 0.1 μm, and is more preferably between 0.01 and 0.08 μm. These are described in U.S. Pat. Nos. 5,264,337, 5,314,789, 5,320,958, and others. In the present invention, when these tabular grains are used, image sharpness is further improved.

The composition of silver halide may be any of silver chloride, silver chlorobromide, silver chloroiodobromide, silver bromide, silver iodobromide, or silver iodide. The photographic emulsion employed in the present invention can be prepared employing methods described in P. Glafkides, "Chimie et Physique Photographique" (published by Paul Montel Co., 1967), G. F. Duffin, "Photographic Emulsion Chemistry" (published by The Focal Press, 1966), V. L. Zelikman et al., "Making and Coating Photographic Emulsion" (published by The Focal Press, 1964), etc. Namely, any of several acid emulsions, neutral emulsions, ammonia emulsions, and the like may be employed. Furthermore, when grains are prepared by allowing soluble silver salts to react with soluble halide salts, a single-jet method, a double-jet method, or combinations thereof may be employed. The resulting silver halide may be incorporated into an image forming layer utilizing any practical method, and at such time, silver halide is placed adjacent to a reducible silver source. Silver halide may be prepared by converting a part or all of the silver in an organic silver salt formed through the reaction of an organic silver salt with halogen ions into silver halide. Silver halide may be previously prepared and the resulting silver halide may be added to a solution to prepare the organic silver salt, or combinations thereof may be used, however the latter is preferred. Generally, the content of silver halide in organic silver salt is preferably between 0.75 and 30 weight percent.

Silver halide is preferably comprised of ions of metals or complexes thereof, in transition metal belonging to Groups 6 to 11 of the Periodic Table. As the above-mentioned metals, preferred are W, Fe, Co, Ni, Cu, Ru, Rh, Pd, Re, Os, Ir, Pt and Au.

These metals may be incorporated into silver halide in the form of complexes. In the present invention, regarding the transition metal complexes, six-coordinate complexes represented by the formula described below are preferred.

$(ML_6)^m$:

wherein M represents a transition metal selected from elements in Groups VIB, VIIB, VIII, and IB of the Periodic Table; L represents a coordinating ligand; and m represents 0, −1, −2, or −3.

Specific examples represented by L include halogens (fluorine, chlorine, bromine, and iodine), cyan, cyanato, thiocyanato, selenocyanato, tellurocyanato, each ligand of azido and aquo, nitrosyl, thionitrosyl, etc., of which aquo, nitrosyl and thionitrosyl are preferred. When the aquo ligand is present, one or two ligands are preferably coordinated. L may be the same or different.

The particularly preferred specific example of M is rhodium (Rh), ruthenium (Ru), rhenium (Re) or osmium (Os).

Specific examples of transition metal ligand complexes are described below.

1: $[RhCl_6]^{3-}$
2: $[RuCl6]^{3-}$
3: $[ReCl_6]^{3-}$
4: $[RuBr_6]^{3-}$
5: $[OsCl_6]^{3-}$
6: $[IrCl_6]^{4-}$
7: $[Ru(NO)Cl_5]^{2-}$
8: $[RuBr_4(H_2O)]^{2-}$
9: $[Ru(NO)(H_2O)Cl_4]^{-}$
10: $[RhCl_5(H_2O)]^{2-}$
11: $[Re(NO)Cl_5]^{2-}$
12: $[Re(NO)CN_5]^{2-}$
13: $[Re(NO)ClCN_4]^{2-}$
14: $[Rh(NO)_2Cl_4]^{-}$
15: $[Rh(NO)(H_2O)Cl_{4-}$
16: $[Ru(NO)CN_5]^{2-}$
17: $[Fe(CN)_6]^{3-}$
18: $[Rh(NS)Cl_5]^{2-}$
19: $[Os(NO)Cl_5]^{2-}$
20: $[Cr(NO)Cl_5]^{2-}$
21: $[Re\ (NO)Cl_5]^{-}$
22: $[Os(NS)Cl_4(TeCN)]^{2-}$
23: $[Ru(NS)Cl_5]^{2-}$
24: $[Re\ (NS)Cl_4(SeCN)]^{2-}$
25: $[Os(NS)Cl(SCN)_4]^{2-}$
26: $Ir(NO)Cl_5]^{2-}$
27: $[Ir(Ns)Cl_5]^{2-}$

One type of these metal ions or complex ions may be employed and the same type of metals or the different type of metals may be employed in combinations of two or more types.

Generally, the content of these metal ions or complex ions is suitably between $1\times10^{-9}$ and $1\times10^{-2}$ mole per mole of silver halide, and is preferably between $1\times10^{-8}$ and $1\times10^{-4}$ mole.

Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation.

These compounds may be added several times by dividing the added amount. Uniform content in the interior of a silver halide grain can be carried out. As described in Japanese Patent Publication Open to Public Inspection No. 63-29603, 2-306236, 3-167545, 4-76534, 6-110146, 5-273683, etc., incorporation can be carried out so as to result preferably in distribution formation in the interior of a grain.

These metal compounds can be dissolved in water or a suitable organic solvent (for example, alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution.

When the addition is carried out onto grain surfaces, an aqueous solution comprising the necessary amount of a metal compound can be placed in a reaction vessel immediately after grain formation, or during physical ripening or at the completion thereof or during chemical ripening.

The light sensitive silver halide emulsion is desalted by washing such as noodle method, flocculation method etc. Desalt processing is not required in the invention.

The light sensitive silver halide grains are preferably chemically ripened. The preferable chemical ripening method includes sulfur sensitization, selenium sensitization and tellurium sensitization. Further noble metal sensitization employing gold, platinum, palladium or iridium compound, or reduction sensitization may be applied.

Organic silver salts employed in the present invention are reducible silver sources and preferred are organic acids and silver salts of hetero-organic acids having a reducible silver ion source, specifically, long chain (having from 10 to 30 carbon atoms, but preferably from 15 to 25 carbon atoms) aliphatic carboxylic acids and nitrogen-containing heterocyclic rings. Organic or inorganic silver salt complexes are also useful in which the ligand has a total stability constant for silver ion of 4.0 to 10.0. Examples of preferred silver salts are described in Research Disclosure, Items 17029 and 29963, and include the following;

Organic acid salts (for example, salts of gallic acid, oxalic acid, behenic acid, arachidinic acid stearic acid, palmitic acid, lauric acid, etc.); carboxyalkylthiourea salts (for example, 1-(3-carboxypropyl)thiourea, 1-(3-carboxypropyl)-3,3-dimethylthiourea, etc.); silver complexes of polymer reaction products of aldehyde with hydroxy-substituted aromatic carboxylic acid (for example, aldehydes (formaldehyde, acetaldehyde, butylaldehyde, etc.), hydroxy-substituted acids (for example, salicylic acid, benzoic acid, 3,5-dihydroxybenzoic acid, 5,5-thiodisalicylic acid, silver salts or complexes of thioenes (for example, 3-(2-carboxyethyl)-4-hydroxymethyl-4-(thiazoline-2-thioene and 3-carboxymethyl-4-thiazoline-2-thioene), complexes of silver with nitrogen acid selected from imidazole, pyrazole, urazole, 1,2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides The preferred silver salt is silver behenate.

Organic silver salts can be prepared by mixing a water-soluble silver compound with a compound which forms a complex with silver, and employed preferably are a normal precipitation, a reverse precipitation, a double-jet precipitation, a controlled double-jet precipitation as described in Japanese Patent Publication Open to Public Inspection No. 9-127643, etc. For example, after forming organic acid alkali metal soap (for example, sodium behenate sodium arginate) by adding alkali metal salt such as sodium hydroxide, potassium oxide, to organic acid, above mentioned soap and silver nitrate etc. are added to form crystals of organic silver salt. In this instance silver halide grain may be mixed.

Various kinds of organic silver salts can be employed for the invention. The organic silver salt is preferably comprised of tabular grains. The organic silver salts preferably comprise tabular grains which are preferably tabular grains exhibiting an aspect ratio of not less than 3, and to make smaller anisotropy in shape of two parallel opposite faces having a maximum area (also denoted as major faces) to achieve closer packing in the light sensitive layer, the tabular grains exhibit an average value of a needle ratio of not less than 1.1 and less than 10.0, and preferably not less than 1.1 and less than 5.0, which can be measured from the direction of the major face.

In this invention, the expression "comprise tabular grains exhibiting an aspect ratio of not less than 3" means that the tabular grains account for at least 50% by number of the total organic silver salt grains. It is more preferred that the organic silver salt comprises tabular grains accounting for at least 60% by number of the total organic silver salt grains, still more preferably at least 70% and most preferably at least 80% by number.

The tabular organic silver salt grain having an aspect ratio of not less than 3 refers to an organic salt grain exhibiting a ratio of grain diameter to grain thickness, being a so-called aspect ratio (also denoted as AR) of 3 or more, which is defined below:

$$AR \text{ diameter } (\mu m)/\text{thickness } (\mu m)$$

wherein when an organic silver salt particle is approximated to be a rectangular parallelepiped, the diameter is the maximum edge length (also denoted as MX LNG) and the thickness is the minimum edge length (also denoted as MN LNG).

The aspect ratio of the tabular organic silver salt particles is preferably within the range of 3 to 20, and more preferably 3 to 10.

The grain diameter was determined in the following manner. An organic silver salt dispersion was diluted, dispersed on the grid provided with a carbon support membrane, and then photographed at a direct magnification of 5,000 times using a transmission type electron microscope (TEM, 2000 FX type, available from Nihon Denshi Co., Ltd.). The thus obtained negative electron micrograph images were read as a digital image by a scanner to determine the diameter (circular equivalent diameter) using appropriate software. At least 300 grains were measured to determine the average diameter.

The TEM image, recorded in an appropriate medium, is decomposed to at least 1024×1024 pixels or preferably at least 2048×2048 pixels, and is then subjected to image processing employing a computer. In order to carry out image processing, an analogue image recorded on a film strip is converted into a digital image employing a scanner etc-, and the resulting image is preferably subjected to shading correction, contrast-edge enhancement, etc., based on specific requirements. Thereafter, a histogram is prepared and the portions corresponding to organic silver are extracted employing binary processing. At least 300 grains of the organic silver salt were manually measured with respect to the thus extracted thickness employing appropriate software.

The average of the needle ratio of the tabular organic silver salt grains is determined according to the procedures described below.

The prepared sample is observed through a secondary electron image, obtained by employing a field emission scanning electron microscope (hereinafter referred to as FE-SEM), and the resulting image is stored on suitable recording media for image processing by computer machine.

Procedures of the above-mentioned image processing are as follows. First, a histogram is prepared and portions corresponding to tabular organic silver salt grains having an aspect ratio of 3 or more are extracted employing binary processing. Inevitable coagulated grains are cut employing a suitable algorithm or a manual operation and are subjected to boarder extract. Thereafter, both maximum length (MX LNG) and minimum width (WIDTH) between two parallel lines are measured for at least 1000 grains, and the needle ratio of each grain is obtained employing the formula described below. The maximum length (MX LNG) is the maximum value of the straight length between two points within a grain. The minimum width between two parallel lines is a minimum distance of two parallel lines drawn circumscribing the grain.

$$\text{Needle ratio}=(MX\ LNG)/(\text{WIDTH})$$

Thereafter, the number average of the needle ratio is calculated for all measured particles.

Details of image processing technology may be had by referring to "Gazoshori Oyogijutsu (Applied Technology in Image Processing)", edited by Hiroshi Tanaka, (Kogyo Chosa Kai). Image processing programs or apparatuses are not particularly restricted, as long as the above-mentioned operation is possible. Cited as one example is Luzex-III, manufactured by Nireko Co.

Methods to prepare organic silver salt grains having the above-mentioned shape are not particularly restricted. The optimization of various conditions such as maintaining the mixing state during the formation of an organic acid alkali metal salt soap and/or the mixing state during the addition of silver nitrate to said soap.

After tabular organic silver salt grains employed in the present invention are preliminarily dispersed together with binders, surface active agents, etc., if desired, the resulting mixture is preferably dispersed and pulverized by a media homogenizer, a high pressure homogenizer, or the like. During said preliminary dispersion, ordinary stirrers such as an anchor type, a propeller type, etc., a high speed rotation centrifugal radial type stirrer (Dissolver), as a high speed shearing stirrer (homomixer) may be employed.

Furthermore, employed as said media homogenizers may be rolling mills such as a ball mill, a satellite ball mill, a vibrating ball mill, medium agitation mills such as a bead mill, atriter, and others such as a basket mill. Employed as high pressure homogenizers may be various types such as a type in which collision occurs against a wall or a plug, a type in which liquid is divided into a plurality of portions and said portions are subjected to collision with each other, a type in which liquid is forced to pass through a narrow orifice, etc.

Examples of ceramics employed as the ceramic beads include $Al_2O_3$, $BaTiO_3$, $SrTiO_3$, MgO, ZrO, BeO, $Cr_2O_3$, $SiO_3$, $SiO_2$—$Al_2O_3$, $Cr_2O_3$—MgO, MgO—CaO, MoO—C, MgO—$Al_2O_3$ (spinel), SiC, $TiO_2$, $K_2O$, $Na_2O$, BaO, PbO, $B_2O_3$, $BeAl_2O_4$, $Y_3Al_5O_{12}$, $ZrO_2$—$Y_2O_3$ (cubic zirconia), 3BeO—$Al_2O_{3-6}SiO_2$ (artificial emerald), C (artificial diamond), $SiO_2$-$nH_2O$, silicone nitride, yttrium-stabilized-zirconia, zirconia-reinforced-alumina. Yttrium-stabilized-zirconia and zirconia-reinforced-alumina are preferably employed in view that little impurity is generated by friction among the beads or the classifier during classifying them. The ceramics containing zirconia are called zirconia as an abbreviation.

In devices employed for dispersing the tabular organic silver salt grains employed in the present invention, preferably employed as the members which are in contact with the organic silver salt grains are ceramics such as zirconia, alumina, silicone nitride, boron nitride, or diamond. Of these, zirconia is the one most preferably employed.

While carrying out of the above-mentioned dispersion, the binder is preferably added so as to achieve a concentration of 0.1 to 10 wt % with reference to the weight of the organic silver salt, and the temperature is preferably maintained at no less than 45° C. from the preliminary dispersion to the main dispersion process. An example of the preferable operation conditions of a homogenizer, when employing high-pressure homogenizer as the dispersing machine, is twice or more operations at 29.42 to 98.06 MPa. In the case when a media-dispersing machine is employed, a circumferential speed of 6 to 13 m/sec. is preferable.

The content of the zirconia in a light sensitive emulsion containing light sensitive silver halide and inorganic silver salt is preferably 0.01 to 0.5 mg, and more preferably 0.01 to 0.3 mg per g of silver. The zirconia is preferably in the form of fine particles having a diameter of not more than 0.02 $\mu$m.

One feature of the light sensitive emulsion used in the invention is that when the cross section, vertical to the support of the photothermographic material is observed through an electron microscope, organic silver salt particles exhibiting a grain projected area of less than 0.025 $\mu m^2$ account for at least 70% of the total grain projected area and organic silver salt particles exhibiting a grain projected area of not less than 0.2 $\mu m^2$ account for not more than 10% of the total grain projected area. In such a case, coagulation of the organic silver salt grains is minimized in the light sensitive emulsion, resulting in a homogeneous distribution thereof.

The conditions for preparing the light sensitive emulsion having such a feature are not specifically limited but include, for example, mixing at the time of forming an alkali metal soap of an organic acid and/or mixing at the time of adding silver nitrate to the soap being maintained in a favorable state, optimization of the ratio of the soap to the silver nitrate, the use of a media dispersing machine or a high pressure homogenizer for dispersing pulverization, wherein dispersion is conducted preferably in a binder content of 0.1 to 10% by weight, based on the organic silver salt, the dispersion including the preliminary dispersion is carried out preferably at a temperature of not higher than 45° C., and a dissolver, as a stirrer is preferably operated at a circumferential speed of at least 2.0 m/sec.

The projected area of organic silver salts grain having a specified projection area and the desired proportion thereof, based on the total grain projection area can be determined by the method using a transmission type electron microscope (TEM) in a similar manner, as described in the determination of the average thickness of tabular grains having an aspect ratio of 3 or more. In this case, coagulated grains are regarded as a single grain when determining the grain area (AREA). At least 1000 grains, and preferably at least 2000 grains are measured to determine the area and classified into three groups, i.e., A: less than 0.025 $\mu m^2$, B: not less than 0.025 $\mu m^2$ and less than 0.2 $\mu m^2$ and C: more than 0.2 $\mu m^2$. In this invention, it is preferable that the total projected area of grains falling within the range of "A" accounts for at least 70% of the projected area of the total grains and the total projected area of grains falling within the range of "C" accounts for not more than 10% of the projected area of total grain.

Details of image processing technology may be had by referring to "Gazoshori Oyogijutsu (Applied Technology in Image Processing)", edited by Hiroshi Tanaka, (Kogyo Chosa Kai). Image processing programs or apparatuses are not particularly restricted, as long as the above-mentioned operation is possible. Cited as one example is Luzex-III, manufactured by Nireko Co.

The organic silver salt grains used in this invention are preferably monodisperse. The degree of monodispersion is preferably 1 to 30% and monodisperse particles in this range lead to the desired high density images. The degree of monodispersion is defined as below:

Degree of monodispersion=(standard deviation of particle size)/(average particle size)×100 (%).

The average particle size of organic silver salt is preferably 0.01 to 0.8 $\mu m$, and more preferably 0.05 to 0.5 $\mu m$. The particle size refers to the diameter of a circle having an area equivalent to the projected area of the particle (i.e., circular equivalent diameter).

To prevent hazing of the light sensitive material, the total amount of silver halide and organic silver salt is preferably 0.5 to 2.2 g in equivalent converted to silver per $m^2$, thereby leading to high contrast images.

Inclusion of a cross-linking agent is specifically effective in the invention. Although the mechanism has not been elucidated, it was proved that the combined use of the cross-linking agent and the labile species-generating compound used relating to the invention gave advantageous effects on storage stability on the dark room and production of print-out silver under daylight. Although it is commonly known that the use of a cross-linking agent in such a binder as described above improves layer adhesion and lessens unevenness in development, it is unexpected that the use of the crosslinking agent in combination with the labile species-generating compound was effective in fog inhibition during storage and prevention of print-out after development.

Crosslinking agents usable in the invention include various commonly known crosslinking agents used for photographic materials, such as aldehyde type, isocyanate type, epoxy type, ethyleneimine type, vinylsulfon type, sulfon ester type, acryloyl type, carbodiimide type, and silane type crosslinking agents, as described in JP-A 50-96216. The preferable examples are isocyanate type, silane type and epoxy type cross-linking agent.

In order to control the light amount or wavelength distribution which transmitted to the photosensitive layer, the photothermographic materials according to the present invention is preferably provided with a filter layer on the same side as of said photosensitive layer, or alternatively on the opposite side of the same, or is preferably comprised of dyes or pigments. Employed as said dyes may be compounds known in the art which absorb light of various wavelength ranges corresponding to the spectral sensitivity of the employed photosensitive materials. For example, when said photothermographic materials are image recording materials employing infrared rays, squalirium dyes having a thiopyrilium nucleus and squalirium dyes having a pyrilium nucleus, thiopyrilium chroconium dyes similar to squalirium dyes, or pylirium chroconium dyes are preferably employed.

Reducing agents are preferably incorporated into the thermally developable photosensitive material of the present invention. Examples of suitable reducing agents are described in U.S. Pat. Nos. 3,770,448, 3,773,512, and 3,593,863, and Research Disclosure Items 17029 and 29963, and include the followings: Aminohydroxycycloalkenone compounds (for example, 2-hydroxypiperidino-2-cyclohexane); esters of amino reductones as the precursor of reducing agents (for example, piperidinohexose reducton monoacetate); N-hydroxyurea -,derivatives (for example, N-p-methylphenyl-N-hydroxyurea); hydrazones of aldehydes or ketones (for example, anthracenealdehyde phenylhydrazone; phosphamidophenols; phosphamidoanilines; polyhydroxybenzenes (for example, hydroquinone, t-butylhydroquinone, isopropylhydroquinone, and (2,5-dihydroxy-phenyl)methylsulfone); sulfydroxamic acids (for example, benzenesulfhydroxamic acid); sulfonamidoanilines (for example, 4-(N-methanesulfonamide)aniline); 2-tetrazolylthiohydroquinones (for example, 2-methyl-5-(1-phenyl-5-tetrazolylthio)hydroquinone); tetrahydroquinoxalines (for example, 1,2,3,4-tetrahydroquinoxaline); amidoxines; azines (for example, combinations of aliphatic carboxylic acid arylhydrazides with ascorbic acid); combinations of polyhydroxybenzenes and hydroxylamines, reductones and/or hydrazine; hydroxamic acids; combinations of azines with sulfonamidophenols; α-cyanophenylacetic acid derivatives; combinations of bis-β-naphthol with 1,3-dihydroxybenzene derivatives; 5-pyrazolones, sulfonamidophenol reducing agents, 2-phenylindane-1,3-dione, etc.; chroman; 1,4-dihydropyridines (for example, 2,6-dimethoxy-3,5-dicarboethoxy-1,4-dihydropyridine); bisphenols (for example, bis(2-hydroxy-3-t-butyl-5-methylphenyl)methane, bis(6-hydroxy-m-tri)mesitol, 2,2-bis(4-hydroxy-3-methylphenyl)propane, 4,5-ethylidene-bis(2-t-butyl-6-methyl)phenol, UV-sensitive ascorbic acid derivatives and 3-pyrazolidones. Of these, particularly preferred reducing agents are hindered phenols.

For example, preferred are compounds represented by General Formula (A) described below.

Formula (A)

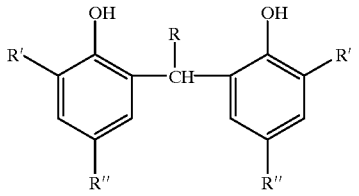

wherein R represents a hydrogen atom or an alkyl group having from 1 to 10 carbon atoms (for example, isopropyl, butyl, and 2,4,4-trimethylpentyl), and R' and R" each represent an alkyl group having from 1 to 5 carbon atoms (for example, methyl, ethyl, and t-butyl).

Exemplary examples of the compounds represented by the formula (A) are shown below.

A-1

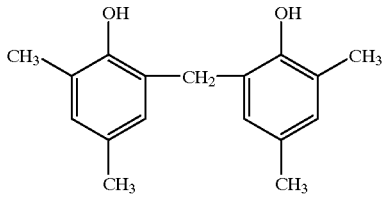

A-2

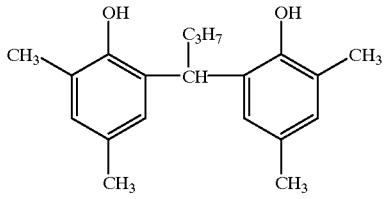

A-3

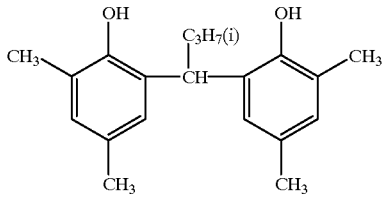

A-4

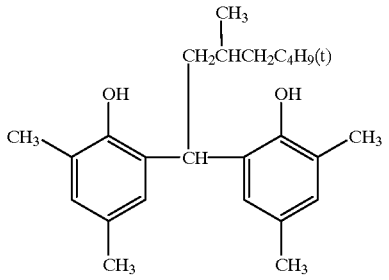

A-5

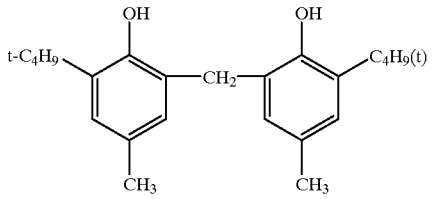

A-6

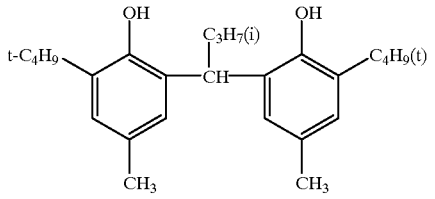

A-7

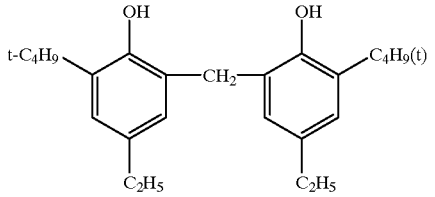

The used amount of reducing agents is preferably between $1\times10^{-2}$ and 10 moles per mole of silver, and is most preferably between $1\times10^{-2}$ and 1.5 moles.

The reducing agent may be incorporated in binder directly or in a form of composite fine particles of the reducing agent with a resin dispersed in water.

Listed as resins employed in this case are water-insoluble copoly(styrene-acrylonitrile), copoly(styrene-butadiene), poly(vinyl acetals) (for example, polylvinyl formal) and poly(vinyl butyral)), poly(esters), poly(urethanes), phenoxy resins, poly(vinylidene chloride), poly(epoxides), poly (carbonates), poly(vinyl acetate), cellulose esters, and the like. Preparation methods of water dispersible fine composite particles are not particularly limited as long as reducing agents are present in resins. For example, it is possible to produce said fine particles in such a manner that reducing agents are dissolved in a solution in which said resins are dissolved, and the resulting mixture is dispersed into an aqueous solution comprising surface active agents as well as dispersing agents. Examples of surface active agents include sodium laurate, sodium dodecyl sulfate, sodium 1-octoxycarbonylmethyl-1-octoxycarbonylmethanesulfonate, sodium dodecylnaphthalenesulfonate, sodium dodecylbenzenesulfonate, sodium dodecylphosphate, cetyltrimethylammonium chloride, docecyltrimethyleneammonium chloride, N-2-ethylhexylpyridinium chloride, polyoxyethylene nonyl phenyl ether, polyoxyethylenesorbitanlaurine ester, and the like. Listed as dispersion stabilizers may be hydrophilic colloids such as gelatin, and polymer dispersing agents prepared by copolymerizing monomers having a hydrophilic group. Listed as monomers having a hydrophilic group may be methacrylic acid, acrylic acid, vinylpyrrolidone, acrylamide, N,N-dimethylacrylamide, maleic acid, itaconic acid, hydroxyethyl methacrylate, hydroxyethyl acrylate, acrylic acid esters having an ethylene oxide group, methacrylic acid esters having an ethylene oxide group, and the like.

In the present invention the image is formed by developing the photosensitive material thermally at 80–140° C., and no fix processing is applied. Therefore silver halide or organic silver in unexposed area are not removed and remain in the photosensitive material.

Optical transmittance density at 400 nm of the photosensitive material including the support after development is preferably not more than 0.2, more preferably not more than 0.02.

In the present invention, a matting agent is preferably incorporated into the image forming layer side. In order to minimize the image abrasion after thermal development, the matting agent is provided on the surface of a photosensitive material and the matting agent is preferably incorporated in an amount of 0.5 to 30 per cent in weight ratio with respect to the total binder in the emulsion layer side.

Materials of the matting agents employed in the present invention may be either organic substances or inorganic substances. Regarding inorganic substances, for example, those can be employed as matting agents, which are silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc. Regarding organic substances, as organic matting agents those can be employed which are starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169.

The shape of the matting agent may be crystalline or amorphous. However, a crystalline and spherical shape is preferably employed. The size of a matting agent is expressed in the diameter of a sphere which has the same volume as the matting agent.

The matting agents preferably employed in the invention are those having average particle size of 0.5 to 10 $\mu$m, more preferably 1.0 to 8.0 $\mu$m. The variation coefficient of size distribution of the matting agent is preferably 50% or less, more preferably 30% or less.

The variation coefficient of size distribution is defined as (standard deviation of grain size)/(average of grain size)×100 (in percent).

The matting agent may be contained in any layers. Preferable example is a layer other than a photosensitive layer, particularly farthest layer from a support.

The matting agent can be applied in a way that the matting agent is coated by coating a composition in which the matting agent is dispersed in coating composition, or the matting agent is sprayed before completion of drying after coating of coating composition. In case that a plurality of matting agents are used in combination both way may be employed in combination.

The thermally developable photosensitive material forms a photographic image by thermal development, and contains, preferably, reducible silver source (organic silver), light sensitive silver halide, reducing agent and toning agent control color if required dispersed in ordinarily (organic) binder matrix.

Thermally developable photosensitive materials are stable at normal temperature, and after exposure, when they are heated to high temperatures (for example, between 80 and 140° C.), they are developed. Upon heating them, silver is formed through an oxidation-reduction reaction of an organic silver salt (working as an oxidizing agent) with a reducing agent. This oxidation-reduction reaction is accelerated with a catalytic action of a latent image formed in photosensitive silver halide by exposure. Silver formed by the reaction of an organic silver salt in an exposed area provides a black image. This is in contrast to the unexposed area, and thereby forms an image. This reaction process proceeds without providing a processing solution such as water from the outside.

The thermally developable photosensitive material comprises a support having thereon at least one image forming layer, and the image forming layer may only be formed on the support. Further, at least one nonphotosensitive layer is preferably formed on the image forming layer. In order to control the amount or wavelength distribution of light transmitted through the image forming layer, a filter layer may be provided on the same side as the image forming layer, or on the opposite side. Dyes or pigments may also be incorporated into the image forming layer. The dye can be employed if it absorbs light having desired wavelength. Preferable examples include compounds described in, for example, Japanese Patent Publication Open to Public Inspection Nos. 59-6481, 59-182436, U.S. Pat. Nos. 4,271,267, 4,594,312, EP-A-533,008, EP-A-652,473, Japanese Patent Publication Open to Public Inspection Nos. 2-216140, 4-348339, 7-191432 and 7-301890.

In the nonlight-sensitive layer preferably contains above mentioned binder and matting agent, and may contain a lubricant such as polysiloxane compound, wax, fluid paraffin.

The light sensitive layer may be formed as plural layers, and in this case higher sensitivity layer is positioned at the inner layer or outer layer for the purpose of contrast control.

Image color control agents are preferably incorporated into the thermally developable photosensitive material of the present invention. Examples of suitable image color control agents are disclosed in Research Disclosure Item 17029, and include the following:

imides (for example, phthalimide), cyclic imides, pyrazoline-5-ons, and quinazolinon (for example, succinimide, 3-phenyl-2-pyrazoline-5-on, 1-phenylurazole, quinazoline and 2,4-thiazolidion); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides (for example, N-(dimethylaminomethyl)phthalimide); blocked pyrazoles, isothiuronium derivatives and combinations of certain types of light-bleaching agents (for example, combination of N,N'-hexamethylene(l-carbamoyl-3,5-dimethylpyrazole), 1,8-(3,6-dioxaoctane)bis-(isothiuroniumtrifluoroacetate), and 2-(tribromomethylsulfonyl)benzothiazole; merocyanine dyes (for example, 3-ethyl-5-((3-ethyl-2-benzothiazolinylidene(benzothiazolinylidene))-1-methylethylidene-2-thio-2,4-oxazolidinedione); phthalazinone, phthalazinone derivatives or metal salts thereof (for example, 4-(l-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, 6-chlorophthalazinone+benzenesulfinic acid sodium or 8-methylphthalazinone+p-trisulfonic acid sodium); combinations of phthalazine+phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, naphtoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H,4H-2,3a,5,6a-tatraazapentalene). Preferred image color control agents include phthalazone or phthalazine.

A mercapto compound, disulfide compound or thion compound may be incorporated in for controlling the development to accelerate or retard, improving efficiency of optical sensitization, improving preserve ability of the photosensitive material before or after development.

The mercapto compound is preferably that represented by Ar—SM, Ar—S—S—Ar, wherein M is a hydrogen or alkali metal atom, Ar is an aromatic cycle or condensed aromatic cycle containing at least one of nitrogen, sulfur, selenium or tellurium. The preferable heterocycle examples includes benzimidazole, naphthoimidazole, benzothiazole, naphthothiazole, benzooxazole, naphthooxazole, benzoselenazole, benzotetrazole, imidazole, oxazole, pyrrazole, triazole, tetrazole, triazine, pyrimidine, pyridazine, pyrazine, pyridine, purine, quinoline, or quinazoline. The heterocycle may have a substituent that is selected from a group consisting of halogen (Br or Cl), hydroxy, amino, carboxy, alkyl (for example, those having at least one carbon atom, preferably 1–4 carbon atoms), and alkoxy (for example, those having at least one carbon atom, preferably 1–4 carbon atoms). Examples of mercapto substituted heterocyclic compound include 2-mercaptobenzimidazole, 2-mercaptobenzoxazole, 2-mercaptobenzthiazole, 2-mercapto-5-methylbenzothiazole, 3-mercapto-1,2,4-triazole, 2-mercaptoquinoline, 8-mercaptopurine, 2,3,5,6-tetrachloro-4-pyridinediol, 4-hydroxy-2-mercaptopyrimidine, 2-mercapto-4-phenyloxazole.

Antifoggants may be incorporated into the thermally developable photosensitive. Mercury ion is conventionally known as the most effective anti-foggant. Employing mercury compound in a photosensitive layer is disclosed in U.S. Pat. Nos. Preferred are those antifoggants as disclosed in, for example, U.S. Pat. No. 3,589,903. However mercury compound is not desirable because of environmental problems. As for a mercury-free antifoggants, compounds disclosed in U.S. Pat. No. 4,546,075 and Japanese Patent Publication Open to Public Inspection No. 59-57234 are preferable.

Particularly preferred mercury-free antifoggants are heterocyclic compounds having at least one substituent, represented by —C(X1)(X2)(X3) (wherein X1 and X2 each represents halogen, and X3 represents hydrogen or halogen), as disclosed in U.S. Pat. Nos. 3,874,946 and 4,756,999. As examples of suitable antifoggants, employed preferably are compounds and the like described in paragraph numbers 0030 to 0036 of Japanese Patent Publication Open to Public Inspection No. 9-288328. The other examples of suitable antifoggants employed preferably are compounds described in paragraph numbers 0062 and 0063 of Japanese Patent Publication Open to Public Inspection No. 9-90550.

Furthermore, more suitable antifoggants are disclosed in U.S. Pat. No. 5,028,523, and U.K. Patent Application Nos. 9221383.4, 9300147.7, and 9311790.1.

In the thermally developable photosensitive material of the present invention, employed can be sensitizing dyes described, for example, in Japanese Patent Publication Open to Public Inspection Nos. 63-159841, 60-140335, 63-231437, 63-259651, 63-304242, and 63-15245; U.S. Pat. Nos. 4,639,414, 4,740,455, 4,741,966, 4,751,175, and 4,835,096. Useful sensitizing dyes employed in the present invention are described, for example, in publications described in or cited in Research Disclosure Items 17643, Section IV-A (page 23, December 1978), 1831, Section X (page 437, August 1978). Particularly, selected can advantageously be sensitizing dyes having the spectral sensitivity suitable for spectral characteristics of light sources of various types of scanners. For example, dyes are preferably selected from compounds described in Japanese Patent Publication Open to Public Inspection Nos. 9-134078, 9-54409 and 9-80679.

The additives may be incorporated in any layer of photosensitive layer, non-photosensitive layer, or other component layer. In the thermally developable photosensitive material surfactant, anti-oxidant, stabilizer, plasticizer, UV ray absorber, coating aid etc. may be employed. These additives and other additives are disclosed in Research Disclosure 17,029 (June 1978, pages 9–15).

In the photographic light-sensitive material of the present invention, a photographic layer and other hydrophilic colloidal layer can be coated on the support or other layer in various coating manners. Methods of coating include a dip coating method, a roller coating method, a curtain coating method, an extrusion coating method and a slide-hopper coating method, etc. The methods described in Research Disclosure, vol. 176, p. 27 to 28, "Coating procedures" can be usable.

Photothermographic materials in the present invention preferably comprise solvents in an amount ranging from 5 to 1,000 mg/m$^2$, and preferably from 100 to 500 mg/m$^2$ so as to form photosensitive materials which exhibit high sensitivity, less fogging, and higher maximum density. Listed as solvents are, for example, ketones such as acetone, methyl ethyl ketone, isophorone, and the like; alcohols such as methyl alcohol, ethyl alcohol, isopropyl alcohol, cyclohexanol, benzyl alcohol, and the like; glycols such as ethylene glycol, diethylene glycol, trimethylene glycol, propylene glycol, hexylene glycol, and the like; ether alcohols such as ethylene glycol monomethyl ether, diethylene glycol monoethyl ether, and the like; ethers such as isopropyl ether, and the like; esters such as ethyl acetate, butyl acetate, and the like; chlorides such as methylene chloride, dichlorobenzene, and the like; hydrocarbons; and the like. In addition, listed are formamide, dimethylformamide, toluidine, tetrahydrofuran, acetic acid, and the like. However, said solvents are not limited to these examples. Further, these solvents may be employed alone or in combination of several types.

Further, it is possible to control the content of said solvents in photosensitive materials by varying conditions such as temperature conditions and the like during the drying process after the coating process. Furthermore, it is possible to determine the content of said solvents employing gas chromatography under conditions suitable for detecting the incorporated solvents.

EXAMPLES

The present invention will now be detailed with reference to examples.

<Preparation of a Photographic Subbed Support>

A 175 μm thick biaxially stretched and thermally fixed PET film tinted with blue at an optical density of 0.170 (measured by a densitometer PDA-65, produced by Konica Corp.) was subjected to corona discharge treatment of 8 W/m$^2$-minute on both surfaces. Subsequently, the subbing coating composition "a-1", described below, was applied onto one surface so as to form a dried layer thickness of 0.8 μm and then dried at 140° C. The resulting layer was designated as Sublayer A-1. Further, the subbing coating composition "b-1", described below, was applied onto the other surface so as to form a dried layer thickness of 0.8 μm, and subsequently dried at 140° C. The resulting coating, which exhibited antistatic function, was designated as Sublayer B-1.

<<Subbing Coating Composition "a-1">>

| | |
|---|---|
| Copolymer latex (30 percent solids) of butyl acrylate (30 percent by weight), t-butyl acrylate (20 percent by weight), styrene (25 percent by weight), and 2-hydroxyethyl acrylate (25 percent by weight) | 130 g |
| Surface active agent (A) | 0.6 g |
| Hexamethylene-1,6-bis(ethyleneurea) | 0.8 g |
| Water to make | 1 liter |

<<Subbing Coating Composition "b-1">>

| | |
|---|---|
| Copolymer latex (30 percent solids) of butyl acrylate (40 percent by weight), styrene (20 weight percent by weight), and glycidyl acrylate (40 percent by weight) | 13 g |
| Copolymer latex (30 percent solids) | 3 g |

-continued

| | |
|---|---|
| of butyl acrylate (30 percent by weight), t-butyl acrylate (20 percent by weight), styrene (25 percent by weight), and 2-hydroxyethyl acrylate (25 percent by weight) | |
| $SnO_2$ sol (10 percent solids) | 86 g |
| Surface active agent (A) | 0.4 g |

Enough distilled water was added to said mixture to make 1,000 ml so as to prepare a coating composition.

Surface active agent (A)

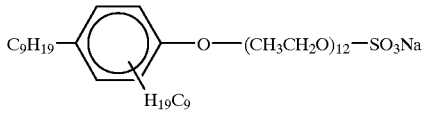

Subsequently, the surface of Sublayer A-1, as well as the surface of Sublayer B-1, was subjected to corona discharge of 8 W/m$^2$·minute. Then the sublayer coating composition "a-2" described below was applied onto Sublayer A-1 so as to obtain a dried layer thickness of 0.2 $\mu$m, and subsequently dried at 140° C. The resulting sublayer was designated as Sublayer A-2. The sublayer coating composition b-2 described below was applied onto Sublayer B-1 so as to obtain a dried layer thickness of 0.2 $\mu$m and subsequently dried at 140° C. The resulting sublayer was designated as Sublayer B-2. In addition, the subcoated support was subjected to thermal treatment at 120° C. for 2 minutes.

<<Subbing Coating Composition "a-2">>

| | |
|---|---|
| 5 weight percent aqueous solution of a water-soluble polymer having an OH group the types are described in Table 2 | 300 g |
| Aqueous butyral resin (Butvar Aqueous Dispersion Br, content ratio of butyral of 34 percent, manufactured by Monsanto Co.) | used amount is described in Table 2 |
| Surface active agent (A) | 0.2 g |
| Silica particles (having an average particle diameter of 2 $\mu$m) | 0.1 g |
| Water to make | 1 liter |

<<Subbing Coating Composition "b-2">>

<<Preparation of Aqueous Polymer Solution>>

Each aqueous polymer solution (having solids of 10 percent by weight) was prepared employing the method described below.

(Preparation of Aqueous Polyester A-1 Solution)

A mixture consisting of 35.4 weight parts of dimethyl terephthalate, 33.63 weight parts of dimethyl isophthalate, 17.92 weight parts of dimethyl 5-sulfoisophthalate sodium salt, 62 weight parts of ethylene glycol, 0.065 weight part of calcium acetate monohydrate, and 0.022 weight part of manganese acetate tetrahydrate, underwent transesterification under a flow of nitrogen gas at 170 to 220° C., while distilling off methanol. Thereafter, 0.04 weight part of trimethyl phosphate, 0.04 weight part of antimony trioxide and 6.8 weight parts of 1,4-cyclohexane dicarboxylic acid, as the polycondensation catalysts, were added and esterification was carried out at a reaction temperature ranging from 220 to 235° C., while distilling off nearly theoretical amount of water. Then the interior of the reaction system was subjected to pressure reduction as well as temperature increase over one hour, and condensation was carried out at 280° C. and no higher than 133 Pa for one hour to prepare aqueous polyester A-1. The intrinsic viscosity of the resulting aqueous polyester A-1 was 0.33.

Subsequently charged into a 2 liter 3-necked flask fitted with a stirring blade, a reflux cooling pipe, and a thermometer were 850 ml of pure water, and 150 g of aqueous polyester A-1 were gradually added while mixed with said stirring blade. After stirring the resulting mixture at room temperature for 30 minutes, said mixture was heated over 1.5 hours so that the interior temperature was raised to 98° C. Then dissolution was carried out for 3 hours while maintaining said temperature. After heating, the resulting medium was cooled to room temperature over one hour and was set aside overnight to prepare 15 weight percent aqueous polyester A-1 solution.

(Preparation of Modified Aqueous Polyester B-1)

Charged into a 3 liter 4-necked flask fitted with a stirring blade, a reflux cooling pipe, a thermometer, and a dripping funnel were 1,900 ml of said 15 weight percent aqueous polyester A-1 solution, and the interior temperature was raised to 80° C. while mixed with said stirring blade. Added dropwise into said solution were 6.52 ml of 24 percent aqueous ammonium peroxide, a monomer mixed solution (35.7 g of ethyl acrylate, and 35.7 g of methyl methacrylate) over 30 minutes, and the resulting mixture underwent reaction for an additional 3 hours. Thereafter, the reaction medium was cooled to 30° C. and filtered to prepare modified aqueous polyester B-1 solution having solids of 10 percent by weight.

(Upper Sublayer Coating Composition "b-2" for Backing Layer Side)

| | |
|---|---|
| Modified aqueous polyester B-1 (having solids of 18 percent by weight) | 56.0 g |
| Surface active agent (A) | 0.1 g |
| Fine silica particles (having an average particle diameter of 2 $\mu$m) | 0.3 g |

Distilled water was added to said mixture to make 1,000 ml so as to obtain a coating composition.

<<Coating onto Back Surface>>

While stirring, 830 g of methyl ethyl ketone (MEK), 84.2 g of cellulose acetate butyrate (CAB 381-20, produced by Eastman Chemical Co.) and 4.5 g of polyester resin (Vitel PE2200B, produced by Bostic Co.) were added and dissolved. Subsequently, 0.30 g of Infrared Dye 1 was added to the resulting solution. Further, 4.5 g of F based surface active agent (Surfron KH40, produced by Asahi Glass Co., Ltd.) dissolved in 43.2 g of methanol and 2.3 g of fluorine based surface active agent (Megafag F120, produced by Danippon Ink and Chemicals Inc.) were added and dissolved while sufficiently stirred. Finally, 75 g of silica (Siloid 64X6000, produced by W.R. Grace Co.) dispersed in methyl ethyl ketone at a concentration of 1 percent by weight, employing a dissolver type homogenizer, were added and stirred to prepare a coating composition for a back surface.

The back surface coating composition as previously described was applied onto the previously prepared sublayer B-2 so as to obtain a dried layer thickness of 3.5 $\mu$m, employing an extrusion coater and subsequently dried. Drying was carried out employing drying air at a drying temperature of 100° C. and a dew point temperature of 10° C.

<<Preparation of Photosensitive Silver Halide Emulsion A>>

| | |
|---|---|
| A1 | |
| Phenylcarbamoyl gelatin | 88.3 g |
| Compound (A) (10 percent aqueous methanol solution) | 10 ml |
| Potassium bromide | 0.32 g |
| Water to make | 5429 ml |
| B1 | |
| 0.76 mole/liter aqueous silver nitrate solution | 2635 ml |
| C1 | |
| Potassium bromide | 51.55 g |
| Potassium iodide | 1.47 g |
| Water to make | 660 ml |
| D1 | |
| Potassium bromide | 154.9 g |
| Potassium iodide | 4.41 g |
| Iridium chloride (1 percent solution) | 0.93 ml |
| Water to make | 1982 ml |
| E1 | |
| 0.4 mole/liter aqueous potassium bromide solution | at an amount to control electric potential described below |
| F1 | |
| Potassium hydroxide | 0.71 g |
| Water to make | 20 ml |
| G1 | |
| 56 percent aqueous acetic acid solution | 18.0 ml |
| H1 | |
| Anhydrous sodium carbonate | 1.72 g |
| Water to make | 151 ml |

Compound (A): HO $(CH_2CH_2O)_n$—$[CH(CH_3)CH_2O]_{17}$—$(CH_2CH_2O)_m$H wherein m+n=5 to 7.

A quarter of the total amount of solution "B1" and the total amount of solution "C1" were added to solution "A1" over 4 minutes 45 seconds, utilizing a mixing/stirring unit shown in Japanese Patent Nos. 58-58283 and 58-58289, as well as a double-jet method, while adjusting the temperature to 45° C. and the pAg to 8.09 so that nuclei were formed. The total amount of solution "F1" was added one minute after addition. During said addition, the pAg was adjusted to the specified value, employing solution "E1". Six minutes after the addition of said solution "F1", three quarters of the total amount of solution "B1" and the total amount of solution "D1" were added over 14 minutes 15 seconds, employing a double-jet method, while adjusting the temperature to 45° C. and the pAg to 8.09. After stirring for 5 minutes, the resulting mixture was heated to 40° C. Subsequently the total amount of solution "G1" was added to sediment a silver halide emulsion. The resulting supernatant was removed while leaving 2,000 ml of the sedimentation portion. Subsequently, 10 liters of water were added. After stirring, the silver halide emulsion was again sedimented. The resulting supernatant was removed while leaving 1,500 ml of the sedimentation portion. Subsequently, solution "H1" was added, and the resulting mixture was heated to 60° C. and stirred for an additional 120 minutes. Finally, the pH was adjusted to 5.8 and water was added so that the amount of water was 1,161 g per mole of silver. Thus photosensitive silver halide emulsion "A" was obtained.

The resulting emulsion was comprised of monodispersed cubic silver bromoiodide grains having an average grain diameter of 0.058 μm, a variation coefficient of grain diameter of 12 percent, and a [100] plane ratio of 92 percent.

<<Preparation of Organic Silver Salt Powder "A">>

Dissolved in 4,720 ml of 80° C. pure water were 130.8 g of behenic acid, 67.7 g of arachidic acid, 43.6 g of stearic acid, and 2.3 g of palmitic acid. Subsequently, 540.2 ml of 5 M sodium hydroxide aqueous solution were added. After further adding 6.9 ml of concentrated nitric acid, the resulting mixture was cooled to 55° C. whereby a sodium fatty acid solution was obtained. While maintaining said sodium fatty acid solution at 55° C., 45.5 g of said photosensitive silver halide emulsion "A" and 450 ml of pure water were added and stirred for 5 minutes.

Subsequently, 702.6 ml of 1 M silver nitrate solution was added over 2 minutes, and the resulting mixture was stirred for 10 minutes whereby an organic silver salt dispersion was obtained. Thereafter, the obtained organic silver salt dispersion was transferred to a washing vessel, in which deionized water was added. The resulting mixture was then set aside so as to allow the organic silver salt dispersion to float and be subjected to separation. Subsequently, the lower water-soluble salts were removed. Thereafter, the resulting dispersion was repeatedly washed with deionized water until the electrical conductivity of the effluent reached 2 μS/cm. After centrifugal water separation, the obtained organic silver salt cake was dried employing an airflow dryer, Flash Jet Dryer, (produced by Seishin Kikaku Co., Ltd.), while controlling operation conditions of nitrogen gas and the hot air temperature at the inlet of said dryer until the water content reached 0.1 percent. Thus, dried organic silver salt powder "A" was obtained.

Incidentally, the water content of organic silver salt compositions was determined employing an infrared ray moisture meter.

<<Preparation of Preliminary Dispersion "A">>

Dissolved in 1,457 g of methyl ethyl ketone (MEK) were 14.57 g of polyvinyl butyral powder (Butvar B-79, manufactured by Monsanto Co.), and 500 g of organic silver salt powder "A" were gradually added and well mixed while stirring, employing a dissolver, Dispermat CA-40M Type (produced by VMA-Getzmann Co). Thus preliminary dispersion "A" was prepared.

<<Preparation of Photosensitive Emulsion 1>>

Said preliminary dispersion "A" was supplied to a media type homogenizer, Dispermat SL-C12EX Type (produced by VMA-Getzmann Co.) in which 80 percent of the interior volume was filled with 0.5 mm diameter zirconia beads (Torecerum manufactured by Toray), employing a pump so that the retention time in the mill was 1.5 minutes, and was dispersed at a mill circumferential speed of 8 m/second, whereby Photosensitive Emulsion 1 was Prepared.

<<Preparation of Stabilizer Solution>>

Dissolved in 4.97 g of methanol were 1.0 g of Stabilizer 1 and 0.31 g of potassium acetate to prepare a stabilizer solution.

Stabilizer 1

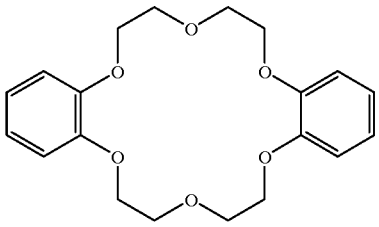

<<Preparation of Infrared Sensitizing Dye Solution "A">>

While light-shielded, 19.2 mg of Infrared Sensitizing Dye No. S-43, 1.488 g of 2-chloro-benzoic acid, 2.779 g of Stabilizer 2, and 365 mg of 5-methyl-2-mercaptobenzimidazole were dissolved in 3 ml of MEK, whereby infrared sensitizing dye solution "A" was prepared.

Dye No. S-43

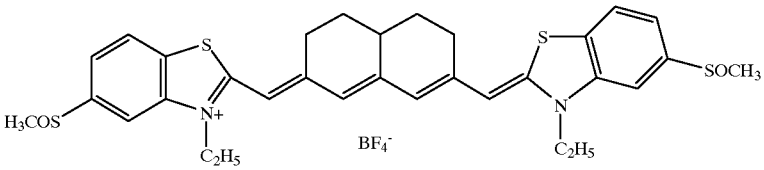

<<Preparation of Additive Solution "a">>

Dissolved in 10 g of MEK were 27.98 g of 1,1-bis(2-hydroxy-3,5-dimethylphenyl)-2-methylpropane as the developing agent), 1.54 g of 4-methylphthalic acid, and 0.48 g of Infrared Dye 1. The resulting solution was designated as Additive Solution "a".

Infrared Dye 1

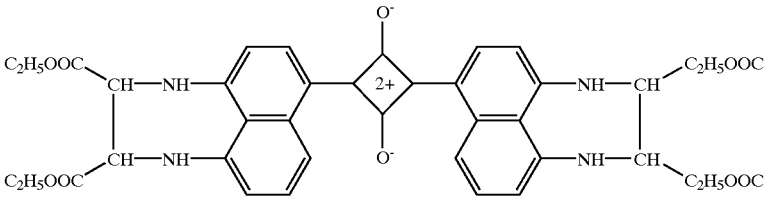

<<Preparation of Additive Solution "b">>

Dissolved in 40.9 9 of MEK were 3.56 9 of Antifoggant 2 and 3.43 9 of phthalazine. The resulting solution was designated as Additive Solution "b".

Antifoggant 2

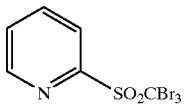

<<Preparation of Photosensitive Layer Coating Composition>>

Said Photosensitive Emulsion 1 (50 g) and 15.11 g of MEK were warmed at 21° C. while stirring under an inert gas (97 percent nitrogen gas) atmosphere, and 1,000 μl of Chemical Sensitizer S-5 (0.5 percent methanol solution) was added. After 2 minutes, 390 μl of Antifoggant 1 (10 percent methanol solution) was added, and the resulting mixture was stirred for one hour. Further, 494 μl of calcium bromide (10 percent methanol solution) was added and the resulting mixture was stirred for 10 minutes. Thereafter, Gold Sensitizer Au-5 (hydrogen tetrachloroaurate) in an amount equivalent to 1/20 mole of said organic chemical sensitizer was added, and the resulting mixture was stirred for 20 minutes. Subsequently, 167 ml of Stabilizer Solution was added, and the resulting mixture was stirred for 10 minutes. Thereafter, 1.32 g of said infrared sensitizing dye solution was added, and the resulting mixture was stirred for one hour. Subsequently, the resulting mixture was cooled to 13° C. and stirred for 30 minutes. While the mixture was maintained at 13° C., 13.31 g of polyvinyl butyral (Butvar B-79, manufactured by Monsanto Co.) was added, and the resulting mixture was stirred for 30 minutes. Thereafter, 1.084 g of tetrachlorophthalic acid (9.4 percent, by weight, MEK solution) was added, and the resulting mixture was stirred for 15 minutes. While stirring, 12.43 g of Additive Solution "a", 1.6 ml of Desmodur N3300/isocyanate manufactured by Mobay Co. (10 percent MEK solution), and 4.27 g of Additive Solution "b" were added in said order and stirred, whereby a photosensitive coating composition was obtained.

Chemical Sensitizer S-5

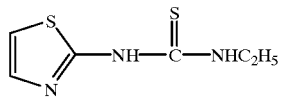

Antifoggant 1

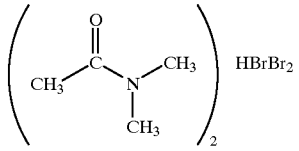

<<Preparation of Matting Agent Dispersion>>

Dissolved in 42.5 g of MEK was 7.5 g of cellulose acetate butyrate (CAB 171-15, manufactured by Eastman Chemical Co.), and 5 g of calcium carbonate (Super-Pflex 200, manufactured by Specialty Minerals Co.) was added to the resulting solution. Then, the resulting mixture was dispersed at 8,000 rpm for 30 minutes employing a dissolver type homogenizer. Thus a matting agent dispersion was prepared.

<<Preparation of Surface Protective Coating Composition>>

While stirring, dissolved in 865 g of MEK (methyl ethyl ketone) were 96 g of cellulose acetate butyrate (CAB 171-15, manufactured by Eastman Chemical Co.), 4.5 g of polymethylmethacrylic acid (Pararoid A-21, manufactured by Rohm & Haas Co.), 1.5 g of vinylsulfon compound (VSC), 1.0 g of benzotriazole and, 1.0 g of fluorine based surface active agent (Surfron KH40, manufactured by Asahi Glass Co.). Subsequently, 30 g of the aforementioned matting agent dispersion was added and stirred, whereby a surface protective layer coating composition was prepared.

<<Coating onto Photosensitive Layer Side>>

Said photosensitive layer coating composition and surface protective layer coating composition were simultaneously applied onto the subbing A-2 surface of a support utilizing an extrusion coater, to prepare Photosensitive Material 101. Coating was accomplished so as to obtain a photosensitive layer having a coated silver amount of 1.9 g/m$^2$ and a surface protective layer having a dried thickness of 2.5 $\mu$m. Subsequently, drying was accomplished employing a drying air having a drying temperature of 75° C. and a dew point temperature of 10° C. for 10 minutes.

Photosensitive Materials 102 through 120 were prepared in the same manner as Photosensitive Material 101, except that the water-soluble polymer component and the type and amount of the aqueous butyral resin of said upper sublayer coating composition a-2 were changed.

<<Preparation of Samples for Evaluation of Storage Stability>>

Each of said Photosensitive Materials was subjected to the following moisture content adjustment. A high humidity treated sample was prepared by storing said sample at 40° C. and 80 percent relative humidity for 168 hours in a light-shielded room, and subsequently, at 23° C. and 55 percent relative humidity for 24 hours. On the other hand, normally treated samples were prepared by storing said sample at 23° C. and 55 percent relative humidity for 192 hours.

<<Exposure and Development>>

Each of the photosensitive materials prepared as above was subjected to laser scanning exposure onto the emulsion surface, employing an exposure unit utilizing as the a semiconductor laser light source which was subjected to a longitudinal mode in the wavelength ranging from 800 to 820 nm under high frequency superposition. At that time, images were formed while adjusting the angle of the exposed surface of the photosensitive material to the laser beam to 75 degrees.

Thereafter, employing an automatic processor having a heating drum, the protective layer of the photosensitive material was brought into contact with said drum surface, and heat development was accomplished at 110° C. for 15 seconds.

Exposure, as well as development, was carried out at 23° C. and 50 percent relative humidity. Obtained images were evaluated employing a densitometer.

<<Evaluation of Storage Stability>>

A value obtained by subtracting the fog value of said normally treated sample from said high humidity treated sample was utilized as the index for the evaluation of storage stability. The smaller the value, the better the storage stability that is exhibited.

<<Evaluation of Layer Adhesion>>

Cellophane adhesive tape, produced by Nichiban Co., was pressed/adhered onto the emulsion side of each sample prior to heat development, and after heat development, and subsequently, the adhered tape was abruptly peeled off at an acute angle. The peeled area of the backing layer was determined and evaluated based on the evaluation rank described below.

1: the adhesive force is very weak, and the backing layer is completely peeled off
2: peeled area is at least 50 percent but less than 100 percent
3: peeled area is at least 20 percent, but less than 50 percent
4: the adhesive force is strong, and peeled area is at least 5 percent but less than 20 percent
5: the adhesive force is quite strong, and peeled area is less than 5 percent.

Products exhibiting an evaluation rank of 4 or 5 were judged to be commercially viable.

<<Evaluation of Separability of Support from Emulsion Layer>>

Each of the prepared samples was subjected to heat treatment at 120° C. for 40 seconds. Subsequently, the resulting sample was cut into 1 cm squares, which were subjected to treatment at 60° C. for one hour employing 1 percent aqueous sodium hydroxide solution. Then they were evaluated as to how the emulsion layer peeled off.

1: when rubbed strongly, no part peels off
2: when rubbed strongly, some part peels off
3: when rubbed strongly, the entire part peels off
4: when rubbed weakly, the entire part peels off
5: after the treatment, some part peels off As can clearly be seen from Table 2, photosensitive materials according to the present invention exhibit excellent image retention properties after processing, excellent adhesive properties between the support and the emulsion layer, and excellent separability of the emulsion layer from the support, compared to comparative photosensitive materials.

TABLE 2

| | Water-soluble Polymer | | Aqueous Butyral | Storage | Emulsion | | |
|---|---|---|---|---|---|---|---|
| Sample No. | Type | Added amount of Composition a-2 | Added Amount of Composition a-2 | Stability | Layer Adhesion | Layer Separability | Remarks |
| 101 | SP-1 (5% aqueous solution) | 300 g | none | 0.005 | 3 | 4 | Example of Present Invention |
| 102 | SP-2 (5% aqueous solution) | 300 g | none | 0.005 | 3 | 4 | Example of Present Invention |
| 103 | SP-3 (5% aqueous solution) | 300 g | none | 0.005 | 3 | 4 | Example of Present Invention |

TABLE 2-continued

| | Water-soluble Polymer | | Aqueous Butyral | Storage | Emulsion | | |
|---|---|---|---|---|---|---|---|
| Sample No. | Type | Added amount of Composition a-2 | Added Amount of Composition a-2 | Stability | Layer Adhesion | Layer Separability | Remarks |
| 104 | SP-4 (5% aqueous solution) | 300 g | none | 0.003 | 4 | 4 | Example of Present Invention |
| 105 | SP-5 (5% aqueous solution) | 300 g | none | 0.003 | 4 | 4 | Example of Present Invention |
| 106 | SP-6 (5% aqueous solution) | 300 g | none | 0.003 | 4 | 4 | Example of Present Invention |
| 107 | SP-7 (5% aqueous solution) | 300 g | none | 0.003 | 4 | 4 | Example of Present Invention |
| 108 | SP-8 (5% aqueous solution) | 300 g | none | 0.003 | 4 | 4 | Example of Present Invention |
| 109 | SP-9 (5% aqueous solution) | 300 g | none | 0.001 | 4 | 4 | Example of Present Invention |
| 110 | SP-9 (5% aqueous solution) | 150 g | none | 0.001 | 4 | 4 | Example of Present Invention |
| 111 | SP-9 (5% aqueous solution) | 450 g | none | 0.001 | 4 | 4 | Example of Present Invention |
| 112 | SP-9 (5% aqueous solution) | 300 g | 2.2 g | 0.001 | 5 | 4 | Example of Present Invention |
| 113 | SP-10 (5% aqueous solution) | 300 g | none | 0.001 | 4 | 4 | Example of Present Invention |
| 114 | SP-10 (5% aqueous solution) | 150 g | none | 0.001 | 4 | 4 | Example of Present Invention |
| 115 | SP-10 (5% aqueous solution) | 450 g | none | 0.001 | 4 | 4 | Example of Present Invention |
| 116 | SP-10 (5% aqueous solution) | 300 g | 2.2 g | 0.001 | 5 | 4 | Example of Present Invention |
| 117 | SP-11 (5% aqueous solution) | 300 g | none | 0.006 | 3 | 5 | Example of Present Invention |
| 118 | P-1 | 50 g | none | 0.005 | 4 | 1 | Comparative Example |
| 119 | P-2 | 273 g | none | 0.03 or more | 1 | 5 | Comparative Example |
| 120 | P-3 | 150 g | none | 0.03 or more | 2 | 5 | Comparative Example |

P-1: latex (solid 30 percent by weight) employed in subbing coating composition "a-1"
P-2: aqueous sodium polystyrene solution (solid 33 percent by weight)
P-3: aqueous sodium polyacrylate solution (solid 10 by weight)
Water-soluble polymers employed in Examples of the present invention
SP-1: dextran (having a weight average molecular weight of 30,000)
SP-2: dextran (having a weight average molecular weight of 70,000)
SP-3: gua gum (having a weight average molecular weight of 40,000)
SP-4: polyvinyl alcohol (Trade Name PVA-217, manufactured by Kuraray Co., Ltd.)
SP-5: polyvinyl alcohol (Trade Name PVA-235, manufactured by Kuraray Co., Ltd.)
SP-6: polyvinyl alcohol (Trade Name PVA-117, manufactured by Kuraray Co., Ltd.)
SP-7: polyvinyl alcohol (Trade Name PVA-420, manufactured by Kuraray Co., Ltd.)
SP-8: polyvinyl alcohol (Trade Name PVA-205, manufactured by Kuraray Co., Ltd.)
SP-9: ethylene copolymerized polyvinyl alcohol (having a degree of saponification of 98 and a viscosity of 5 mPa · S (4 percent aqueous solution at 20° C., Trade Name RS-4105, manufactured by Kuraray Co., Ltd.)
SP-10: ethylene copolymerized polyvinyl alcohol (having a degree of saponification of 98 and a viscosity of 28 mPa · S (4 percent aqueous solution at 20° C., Trade Name RS-2117, manufactured by Kuraray Co., Ltd.)
SP-11: polyethylene glycol (having a number average molecular weight of 20,000)

Example 2

Photosensitive Materials 201 through 220 were prepared in the same manner as Photosensitive Materials 101 through 120, except that as upper sublayer coating composition "b-2", another one, which was the same as "a-2", was employed. Each of said prepared Photosensitive Materials was evaluated in the same manner as Example 1, and results similar to those of Example 1 were obtained.

What is claimed is:

1. A photothermographic dry imaging material comprising a support, a photosensitive layer containing at least an organic silver salt, photosensitive silver halide, a reducing agent and a binder, and a subbing layer containing a water-soluble polymer having a hydroxy group, provided on the support and wherein the subbing layer comprises butyral resin.

2. The photothermographic dry imaging material of claim 1, wherein the water-soluble polymer having a hydroxy group is polyvinyl alcohol.

3. The photothermographic dry imaging material of claim 1, wherein the water-soluble polymer having a hydroxy group is ethylenically copolymerized polyvinyl alcohol.

4. The photothermographic dry imaging material of claim 2, wherein the subbing layer on at least one side of the support is composed of two or more sublayer, and the sublayer farthest from the support contains the water-soluble polymer and an aqueous butyral resin.

5. The photothermographic dry imaging material of claim 4, wherein a sublayer contacting to the support comprises polymer latex.

6. The photothermographic dry imaging material of claim 2, wherein the subbing layer containing butyral resin is formed by coating composition containing liquid in which butyral resin is dispersed.

7. The photothermographic dry imaging material of claim 1, wherein the butyral resin is particles having number average diameter of 50 to 1000 nm.

8. The photothermographic dry imaging material of claim 7, wherein the butyral resin is contained in amount of 2 to 40 percent by weight with respect to weight of the water-soluble polymer.

9. The photothermographic dry imaging material of claim 8, wherein the water-soluble polymer comprises polyvinyl alcohol unit 50 percent or more by molar ratio.

10. The photothermographic dry imaging material of claim 9, wherein the subbing layer contains the water-soluble polymer in amount of 40 percent by weight or more.

* * * * *